US008545007B2

(12) United States Patent
Fukui

(10) Patent No.: US 8,545,007 B2
(45) Date of Patent: Oct. 1, 2013

(54) IMAGE FORMING APPARATUS

(75) Inventor: Takashi Fukui, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 58 days.

(21) Appl. No.: 13/187,063

(22) Filed: Jul. 20, 2011

(65) Prior Publication Data

US 2012/0019606 A1 Jan. 26, 2012

(30) Foreign Application Priority Data

Jul. 21, 2010 (JP) ..... 2010-164250

(51) Int. Cl.
*B41J 2/01* (2006.01)

(52) U.S. Cl.
USPC ..... 347/104; 347/101

(58) Field of Classification Search
USPC ..... 347/104; 271/112; 399/159, 174; 358/1.9; 430/48
See application file for complete search history.

(56) References Cited

U.S. PATENT DOCUMENTS

| | | | | |
|---|---|---|---|---|
| 5,550,618 | A * | 8/1996 | Herbert et al. | 399/159 |
| 6,385,420 | B1 * | 5/2002 | Morioka | 399/174 |
| 2008/0261131 | A1 * | 10/2008 | Nakayama et al. | 430/48 |
| 2010/0025920 | A1 * | 2/2010 | Williams | 271/112 |
| 2010/0149567 | A1 * | 6/2010 | Kanazawa et al. | 358/1.9 |

FOREIGN PATENT DOCUMENTS

| | | | |
|---|---|---|---|
| JP | 6-242703 | A | 9/1994 |

* cited by examiner

*Primary Examiner* — Manish S Shah
*Assistant Examiner* — Yaovi Ameh
(74) *Attorney, Agent, or Firm* — Birch, Stewart, Kolasch & Birch, LLP

(57) ABSTRACT

An image forming apparatus includes: a conveyance drum which has a round cylindrical shape including an outer circumferential surface having a medium holding section, and rotates in a prescribed direction while holding a medium in tight contact on the medium holding section so as to convey the medium in a circumferential direction; a pressing device which presses the medium against the medium holding section so as to establish tight contact between the medium and the medium holding section, when causing the medium to make tight contact with the medium holding section; a holding force generating device which generates a holding force that holds the medium on the medium holding section; and a liquid ejection head which ejects a liquid onto the medium held on the medium holding section, wherein: the conveyance drum has a level difference section which is provided on at least one side, in an axial direction of the conveyance drum, with respect to a central portion in the axial direction of the conveyance drum, the level difference section having a larger diameter than the central portion so as to project beyond an outer circumferential surface of the central portion; and the level difference section has a length, in the circumferential direction, smaller than a length of the medium holding section in the circumferential direction.

13 Claims, 16 Drawing Sheets

IMAGE FORMING APPARATUS

BACKGROUND OF THE INVENTION

1. Field of the Invention

The present invention relates to an image forming apparatus, and more particularly to a technique for holding and fixing a medium and a technology for conveying a medium related to an image forming apparatus which conveys a medium by a drum conveyance method and forms an image on the medium.

2. Description of the Related Art

As a generic image forming apparatus, an inkjet recording apparatus which forms a color image on a recording medium by using color ink is known. The inkjet recording apparatus needs to cause a recording medium to make tight contact with the conveyance member which conveys the recording medium, in order to form an image in a state of close proximity between the inkjet head and the recording medium. For example, in a drum conveyance method which fixes and conveys a recording medium on the outer circumferential surface of a conveyance drum, a mode is adopted in which a recording medium is pressed using a pressing roller so as to be made tight contact with the circumferential surface of the conveyance drum, but if localized floating of the recording medium occurs due to deformation of the recording medium, or the like, wrinkles occur in the recording medium due to the pressure applied by the pressing roller. Wrinkles of this kind in the recording medium cause dramatic decline in the image quality and therefore require countermeasures.

Japanese Patent Application Publication No. 06-242703 discloses a technology for an image recording apparatus based on a pressure transfer fixing method, according to which the respective ends of recording paper in the width direction are conveyed more quickly than the central portion of the recording paper, thus preventing the occurrence of wrinkles in the recording paper, by forming an inverted crown shape in one of a pair of nip rollers in a last stage which conveys recording paper to a pressure contact section between an image carrier body and a pressure roller.

However, in the drum conveyance method described above, it is necessary to cause the paper to make tight contact along the circumferential surface of a conveyance drum, and therefore floating up in paper which has deformed stands out. In particular, when printing onto paper having a large amount of deformation, such as paper which has been printed on one surface when carrying out double-side printing, floating up of the paper is liable to occur and wrinkles are liable to arise.

Japanese Patent Application Publication No. 06-242703 discloses a shape of a pair of rollers in a nip conveyance system which conveys a recording medium to a pressure contact unit in an image recording apparatus based on a pressure transfer fixing method, but makes no concrete disclosure of a composition for fixing the recording medium in order to prevent the occurrence of wrinkles caused by deformation of the recording medium in the drum conveyance method.

SUMMARY OF THE INVENTION

The present invention has been contrived in view of these circumstances, an object thereof being to provide an image forming apparatus which avoids decline in quality due to wrinkles, by preventing the occurrence of wrinkles caused by floating when fixing the recording medium.

In order to achieve an aforementioned object, one aspect of the invention is directed to an image forming apparatus comprising: a conveyance drum which has a round cylindrical shape including an outer circumferential surface having a medium holding section, and rotates in a prescribed direction while holding a medium in tight contact on the medium holding section so as to convey the medium in a circumferential direction; a pressing device which presses the medium against the medium holding section so as to establish tight contact between the medium and the medium holding section, when causing the medium to make tight contact with the medium holding section; a holding force generating device which generates a holding force that holds the medium on the medium holding section; and a liquid ejection head which ejects a liquid onto the medium held on the medium holding section, wherein: the conveyance drum has a level difference section which is provided on at least one side, in an axial direction of the conveyance drum, with respect to a central portion in the axial direction of the conveyance drum, the level difference section having a larger diameter than the central portion so as to project beyond an outer circumferential surface of the central portion; and the level difference section has a length, in the circumferential direction, smaller than a length of the medium holding section in the circumferential direction.

According to the present invention, floating up of a medium is prevented by pressing the medium against the outer circumferential surface of a conveyance drum with a pressing device and thereby causing the medium to make tight contact with the medium holding section, and since a level difference section is provided on at least one side of the central portion of the axial direction of the drum, the level difference section having a larger diameter than the central portion in the axial direction and projecting beyond the outer circumferential surface of the central portion in the axial direction, then the occurrence of wrinkles when causing the medium to make tight contact with the outer circumferential surface of the conveyance drum is suppressed, even when using a medium having a large amount of deformation. Moreover, since the level difference section has a length in the circumferential direction which is smaller than the length of the medium holding section in the circumferential direction, then the holding force generated in the medium holding section acts directly on the portion of the medium that is not supported on the level difference section, and therefore detachment of the medium due to insufficient holding force is prevented.

BRIEF DESCRIPTION OF THE DRAWINGS

Preferred embodiments of this invention as well as other objects and beneficial effects thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
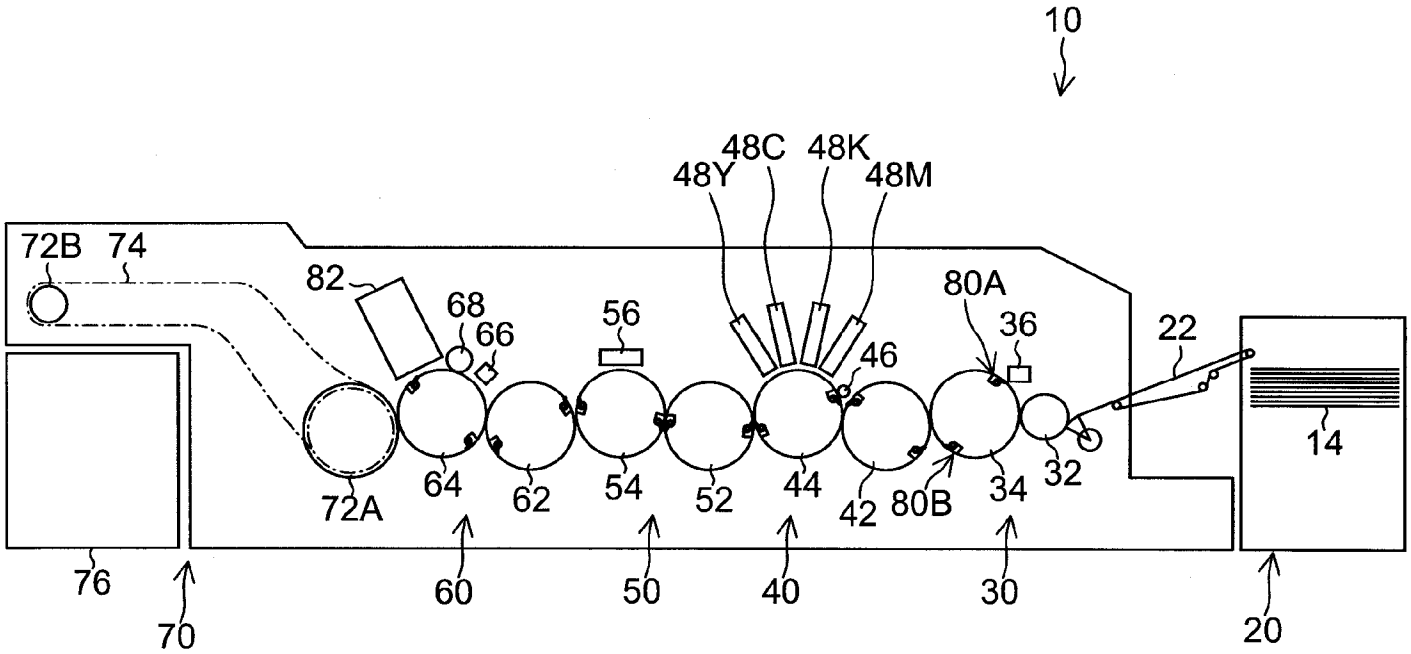
FIG. 1 is a general schematic drawing of an inkjet recording apparatus relating to an embodiment of the present invention.

FIG. 1 is a schematic drawing showing the general composition of an inkjet recording apparatus relating to an embodiment of the present invention. The inkjet recording apparatus 10 shown in FIG. 1 is a recording apparatus based on a two-liquid aggregation system which forms an image on a recording surface of a recording medium 14 on the basis of prescribed image data, by using ink containing coloring material and an aggregating treatment liquid having a function of aggregating the ink.

The inkjet recording apparatus 10 principally comprises a paper feed unit 20, a treatment liquid application unit 30, an image formation unit 40, a drying process unit 50, a fixing process unit 60 and an output unit 70. Transfer drums 32, 42, 52, 62, are provided as devices which receive and transfer a recording medium 14 conveyed respectively from stages prior to the treatment liquid application unit 30, the image formation unit 40, the drying process unit 50, and the fixing process unit 60, and furthermore, pressure drums 34, 44, 54, 64 having a drum shape are provided as devices for holding and conveying the recording medium 14 respectively in the treatment liquid application unit 30, the image formation unit 40, the drying process unit 50 and the fixing process unit 60.

Grippers 80A and 80B which grip and hold the leading end portion of a recording medium 14 are provided on the transfer drums 32 to 62 and the pressure drums 34 to 64. The gripper 80A and the gripper 80B adopt a common structure for gripping and holding the leading end portion of the recording medium 14 and for transferring the recording medium 14 with respect to a gripper provided in another pressure drum or transfer drum; furthermore, the gripper 80A and the gripper 80B are disposed in symmetrical positions separated by 180° in the direction of rotation of the pressure drum 34 on the outer circumferential surface of the pressure drum 34.

When the transfer drums 32 to 62 and the pressure drums 34 to 64 which have gripped the leading end portion of a recording medium 14 by means of the grippers 80A and 80B rotate in a prescribed rotation, the recording medium 14 is rotated and conveyed following the outer circumferential surface of the transfer drums 32 to 62 and the pressure drums 34 to 64. Note that, in FIG. 1, reference numerals are only provided to the grippers 80A and 80B provided in the pressure drum 34, and reference numerals to the grippers in the other pressure drums and transfer drums are omitted.

When a recording medium (cut sheet paper) 14 accommodated in the paper feed unit 20 is supplied to the treatment liquid application unit 30, an aggregating treatment liquid (hereinafter, simply referred to as "treatment liquid") is applied to the recording surface of the recording medium 14 held on the outer circumferential surface of the pressure drum 34. The "recording surface of the recording medium 14" is the outer surface when the medium is held by the pressure drums 34 to 64, this being the surface opposite to the surface held on the pressure drums 34 to 64. Thereupon, the recording medium 14 on which aggregating treatment liquid has been deposited is output to the image formation unit 40 and colored ink is deposited by the image formation unit 40 onto the area of the recording surface where the aggregating treatment liquid has been deposited, thereby forming a desired image.

Moreover, a recording medium 14 on which an image has been formed by the colored inks is sent to the drying process unit 50, and a drying process is carried out by the drying process unit 50, in addition to which the medium is conveyed to the fixing process unit 60 after the drying process and a fixing process is carried out. By carrying out the drying process and the fixing process, the image formed on the recording medium 14 is made durable. In this way, such a desired image is formed on the recording surface of the recording medium 14 and after fixing the image on the recording surface of the recording medium 14, the medium is conveyed to the exterior of the apparatus from the output unit 70.

The respective units of the inkjet recording apparatus 10 (paper feed unit 20, treatment liquid application unit 30, image formation unit 40, drying process unit 50, fixing process unit 60 and output unit 70) are described in detail below.

Paper Feed Unit

The paper feed unit 20 comprises a paper feed tray 22 and a paying out mechanism (not illustrated) and is composed so as to pay out the recording medium 14 one sheet at a time from the paper feed tray 22. The recording medium 14 paid out from the paper feed tray 22 is registered in position by a guide member (not illustrated) in such a manner that the leading end portion is disposed at the position of a gripper (not illustrated) on the transfer drum (paper feed drum) 32.

Treatment Liquid Application Unit

The treatment liquid application unit 30 comprises a pressure drum (treatment liquid drum) 34 which holds, on the outer circumferential surface thereof, a recording medium 14 transferred from the paper feed drum 32 and conveys the recording medium 14 in the prescribed conveyance direction, and a treatment liquid application unit 36 which applies a treatment liquid to the recording surface of a recording medium 14 held on the outer circumferential surface of the treatment liquid drum 34. When the treatment liquid drum 34 is rotated in the counter-clockwise direction in FIG. 1, the recording medium 14 is conveyed so as to rotate in the counter-clockwise direction following the outer circumferential surface of the treatment liquid drum 34.

The treatment liquid application unit 36 shown in FIG. 1 is provided at a position facing the outer circumferential surface (recording medium holding surface) of the treatment liquid drum 34. One example of the composition of the treatment liquid application unit 36 is a mode which comprises a treatment liquid vessel which stores a treatment liquid, an uptake roller which is partially immersed in the treatment liquid in the treatment liquid vessel and which takes up the treatment liquid in the treatment liquid vessel, and an application roller (rubber roller) which moves the treatment liquid taken up by the uptake roller to the recording medium 14. Furthermore, an application roller movement mechanism is provided to move the application roller in the vertical direction (the normal direction to the outer circumferential surface of the treatment liquid drum 34), and when the grippers 80A and 80B arrive at the arrangement position of the application roller, the application roller is moved upward so as to avoid collision with the grippers 80A and 80B.

The treatment liquid deposited on the recording medium 14 by the treatment liquid application unit 30 contains a coloring material aggregating agent which aggregates the coloring material (pigment) in the ink deposited by the image formation unit 40, and when the treatment liquid and the ink come into contact with each other on the recording medium 14, the separation of the coloring material and the solvent in the ink is promoted. Desirably, the treatment liquid application unit 30 doses the amount of treatment liquid applied to the recording medium 14 while applying the treatment liquid, and desirably, the thickness of the film of treatment liquid on the recording medium 14 is sufficiently smaller than the diameter of the ink droplets which are ejected from the image formation unit 40.

Image Formation Unit

The image formation unit 40 comprises a pressure drum (image formation drum) 44 which holds and conveys a recording medium 14, a paper pressing roller 46 for causing the recording medium 14 to make tight contact with the image formation drum 44, and inkjet heads 48M, 48K, 48C and 48Y which deposit ink onto the recording medium 14. The detailed structure of the image formation drum 44 is described below, but the image formation drum 44 comprises grippers 80A, 80B which grip a leading end portion of the recording medium 14 (the reference numerals are not depicted in FIG. 1), and further comprises suction holes (indicated by the reference numerals 322 in FIG. 11) for causing a suction pressure to act on the recording medium 14, in the recording medium holding section (indicated by reference numeral 206 in FIG. 6) which holds the recording medium 14 on the outer circumferential surface of the image formation drum 44. The grippers 80A and 80B are disposed inside recess sections (indicated by reference numeral 210 in FIG. 6) so as not to project beyond the outer circumferential surface of the image formation drum 44, and the leading end of the recording medium 14 is fixed in a state of being pulled inside each recess section.

The paper pressing roller 46 is a guide member for causing the recording medium 14 to make tight contact with the outer circumferential surface of the image formation drum 44, and is disposed facing the outer circumferential surface of the image formation drum 44, to the downstream side, in terms of the conveyance direction of the recording medium 14, of the transfer position of the recording medium 14 between the transfer drum 42 and the image formation drum 44 and to the upstream side, in terms of the conveyance direction of the recording medium 14, of the inkjet heads 48M, 48K, 48C and 48Y.

A paper floating detection sensor (which is not shown) is arranged between the paper pressing roller 46 and the inkjet head 48Y on the furthest upstream side in terms of the conveyance direction of the recording medium 14. The paper floating detection sensor determines the amount of floating of the recording medium 14 immediately before the recording medium 14 enters directly below the inkjet heads 48M, 48K, 48C and 48Y. The inkjet recording apparatus 10 shown in the present embodiment is configured in such a manner that a notification is issued and conveyance of the recording medium 14 is interrupted, if the amount of floating of the recording medium 14 determined by the paper floating detection sensor exceeds a prescribed threshold value.

When the recording medium 14 which has been transferred from the transfer drum 42 to the image formation drum 44 is conveyed to rotate in a state where the leading end is held by a gripper 80A (a gripper 80B), the recording medium 14 is pressed by the paper pressing roller 46 and is caused to make tight contact with the outer circumferential surface of the image formation drum 44. After the recording medium 14 has been caused to make tight contact with the outer circumferential surface of the image formation drum 44 in this way, the recording medium 14 is passed to a printing region directly below the inkjet heads 48M, 48K, 48C and 48Y, without any floating up of the medium from the outer circumferential surface of the image formation drum 44.

The inkjet heads 48M, 48K, 48C and 48Y respectively correspond to inks of the four colors of magenta (M), black (K), cyan (C) and yellow (Y), and are disposed in this order from the upstream side in terms of the direction of rotation of the image formation drum 44 (the counter-clockwise direction in FIG. 1), in addition to which the ink ejection surfaces (nozzle surfaces) of the inkjet heads 48M, 48K, 48C and 48Y are disposed so as to face the recording surface of the recording medium 14 which is held on the image formation drum 44. Here, the "ink ejection surfaces (nozzle surfaces)" are surfaces of the inkjet heads 48M, 48K, 48C and 48Y which face the recording surface of the recording medium 14, and are the surfaces where the nozzles which eject ink as described below are formed (these nozzles are indicated by reference numeral 108 in FIG. 3).

Furthermore, the inkjet heads 48M, 48K, 48C and 48Y shown in FIG. 1 are disposed at an inclination with respect to the horizontal plane in such a manner that the recording surface of a recording medium 14 which is held on the outer circumferential surface of the image formation drum 44 and the nozzle surfaces of the inkjet heads 48M, 48K, 48C and 48M are substantially parallel.

The inkjet heads 48M, 48K, 48C and 48Y are full line heads having a length corresponding to the maximum width of the image forming region on the recording medium 14 (the length of the recording medium 14 in the direction perpendicular to the conveyance direction), and are fixed so as to extend in a direction perpendicular to the conveyance direction of the recording medium 14. Nozzles for ejecting ink are formed in a matrix configuration throughout the whole width of the image forming region of the recording medium 14 on the nozzle surfaces (liquid ejection surfaces) of the inkjet heads 48M, 48K, 48C and 48Y (see FIG. 3).

When the recording medium 14 is conveyed to a printing region directly below the inkjet heads 48M, 48K, 48C and 48Y, inks of respective colors are ejected (as droplets) on the basis of image data, from the inkjet heads 48M, 48K, 48C and 48Y onto the region of the recording medium 14 where an aggregating treatment liquid has been deposited. When the droplets of the colored inks are ejected from the corresponding inkjet heads 48M, 48K, 48C and 48Y toward the recording surface of the recording medium 14 held on the outer circumferential surface of the image formation drum 44, the ink makes contact with the treatment liquid on the recording medium 14, and an aggregating reaction occurs with a coloring material (pigment-based coloring material) which is dispersed in the ink or a coloring material (dye-based coloring material) which can be insolubilized, thereby forming an aggregate of the coloring material. By this means, movement of the coloring material in the image formed on the recording medium 14 (namely, positional displacement of the dots, color non-uniformities of the dots) is prevented.

Furthermore, the image formation drum 44 of the image formation unit 40 is structurally separate from the treatment liquid drum 34 of the treatment liquid application unit 30, and therefore treatment liquid is never applied to the inkjet heads 48M, 48K, 48C and 48Y, and it is possible to reduce the causes of ink ejection abnormalities. Although a configuration with the four standard colors of M, K, C and Y is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

Drying Process Unit

The drying process unit 50 comprises a pressure drum (drying drum) 54 which holds and conveys a recording medium 14 after image formation, and a drying process unit 56 which carries out a drying process for evaporating off the water content (liquid component) on the recording medium 14. The basic structure of the drying drum 54 is common with that of the treatment liquid drum 34 described previously, and therefore further description thereof is omitted here.

The drying process unit 56 is a processing unit which is disposed in a position facing the outer circumferential surface of the drying drum 54 and evaporates off the water content present on the recording medium 14. When ink is deposited on the recording medium 14 by the image formation unit 40, the liquid component (solvent component) of the ink and the liquid component (solvent component) of the treatment liquid which have been separated by the aggregating reaction between the treatment liquid and the ink remain on the recording medium 14, and therefore it is necessary to remove this liquid component.

The drying process unit 56 carries out a drying process by evaporating off the liquid component present on the recording medium 14, through heating by a heater, or air blowing by a fan, or a combination of these, in order to remove the liquid component on the recording medium 14. The amount of heating and the air flow volume applied to the recording medium 14 are set appropriately in accordance with parameters, such as the amount of water remaining on the recording medium 14, the type of recording medium 14, the conveyance speed of the recording medium 14 (interference processing time), and the like.

When a drying process is carried out by the drying process unit 56, since the drying drum 54 of the drying process unit 50 is structurally separate from the image formation drum 44 of the image formation unit 40, then it is possible to reduce the causes of ink ejection abnormalities due to drying of the head meniscus portions in the inkjet heads 48M, 48K, 48C and 48Y as a result of the applied heat or air flow.

In order to display an effect in correcting cockling of the recording medium 14, the curvature of the drying drum 54 is desirably 0.002 (1/mm) or greater. Furthermore, in order to prevent curving (curling) of the recording medium after the drying process, the curvature of the drying drum 54 is desirably 0.0033 (1/mm) or less.

Moreover, desirably, a device for adjusting the surface temperature of the drying drum 54 (for example, an internal heater) may be provided to adjust the surface temperature to 50° C. or above. Drying is promoted by carrying out a heating process from the rear surface of the recording medium 14, thereby preventing destruction of the image in the subsequent fixing process. According to this mode, more beneficial effects are obtained if a device for causing the recording medium 14 to adhere tightly to the outer circumferential surface of the drying drum 54 is provided. Examples of a device for causing tight adherence of the recording medium 14 include a vacuum suctioning device, electrostatic attraction device, and the like.

There are no particular restrictions on the upper limit of the surface temperature of the drying drum 54, but from the viewpoint of the safety of maintenance operations such as cleaning the ink adhering to the surface of the drying drum 54 (e.g. preventing burns due to high temperature), desirably, the surface temperature of the drying drum 54 is equal to or lower than 75° C. (and more desirably, equal to or lower than 60° C.).

By holding the recording medium 14 in such a manner that the recording surface thereof is facing outwards on the outer circumferential surface of the drying drum 54 having this composition (in other words, in a state where the recording surface of the recording medium 14 is curved in a projection shape), and carrying out a drying process while conveying the recording medium in rotation, it is possible reliably to prevent drying non-uniformities caused by wrinkling or floating up of the recording medium 14.

Fixing Process Unit

The fixing process unit 60 comprises a pressure drum (fixing drum) 64 which holds and conveys a recording medium 14, a heater 66 which carries out a heating process on the recording medium 14 which an image has been formed on and liquid has been removed from, and a fixing roller 68 which pressurizes the recording medium 14 from the recording surface side. The basic structure of the fixing drum 64 is common to those of the treatment liquid drum 34 and the drying drum 54, and description thereof is omitted here. The heater 66 and the fixing roller 68 are disposed in positions facing the outer circumferential surface of the fixing drum 64, and are situated in this order from the upstream side in terms of the direction of rotation of the fixing drum 64 (the counter-clockwise direction in FIG. 1).

In the fixing process unit 60, a preliminary heating process by means of a heater 66 is carried out on the recording surface of the recording medium 14, and a fixing process by means of a fixing roller 68 is also carried out. The heating temperature of the heater 66 is set appropriately in accordance with the type of the recording medium, the type of ink (the type of polymer micro-particles contained in the ink), and the like. For example, a possible mode is one where the heating temperature is set to the glass transition temperature or the minimum film forming temperature of the polymer micro-particles contained in the ink.

The fixing roller 68 is a roller member configured so as to heat and pressurize the recording medium 14 for applying heat and pressure to the dried ink in order to melt self-dispersing polymer micro-particles contained in the ink and thereby forming an ink film. More specifically, the fixing roller 68 is disposed so as to contact and press against the fixing drum 64, in such a manner that the fixing roller 68 serves as a nip roller with respect to the fixing drum 64. By this means, the recording medium 14 is sandwiched between the fixing roller 68 and the fixing drum 64 and is nipped with a prescribed nip pressure, whereby a fixing process is carried out.

An example of the composition of the fixing roller 68 is a mode where the roller is constituted by a heating roller which incorporates a halogen lamp inside a metal pipe made of aluminum, or the like, having good heat conductivity. If heat energy at or above the glass transition temperature of the polymer micro-particles contained in the ink is applied by heating the recording medium 14 by means of this heating roller, then the polymer micro-particles melt and a transparent film is formed on the surface of the image.

By applying pressure to the recording surface of the recording medium 14 in this state, the polymer micro-particles which have melted are pressed and fixed into the undulations in the recording medium 14, and the undulations in the image surface are thereby leveled out, thus making it possible to obtain a desirable luster. A desirable composition is one where fixing rollers 68 are provided in a plurality of stages, in accordance with the thickness of the image layer and the glass transition temperature characteristics of the polymer micro-particles.

Furthermore, desirably, the surface hardness of the fixing roller 68 is equal to or lower than 71°. By further softening the surface of the fixing roller 68, it is possible to expect effects in following the undulations of the recording medium 14 which are produced by cockling, and fixing non-uniformities caused by the undulations of the recording medium 14 are prevented more effectively.

The inkjet recording apparatus 10 shown in FIG. 1 comprises an in-line sensor 82 which is provided at a later stage of the processing region of the fixing process unit 60 (on the downstream side in terms of the direction of conveyance of the recording medium). The in-line sensor 82 is a sensor for reading the image formed on the recording medium 14 (or a test pattern (check pattern) formed in the margin area of the recording medium 14), and desirably employs a CCD line sensor.

In the inkjet recording apparatus 10 shown in the present embodiment, the presence and absence of ejection abnormalities in the inkjet heads 48M, 48K, 48C and 48Y are judged on the basis of the reading results of the in-line sensor 82. Furthermore, the in-line sensor 82 may include measurement devices for measuring the water content, surface temperature, luster (gloss level), and the like. According to this mode, parameters, such as the processing temperature of the drying process unit 50 and the heating temperature and applied pressure of the fixing process unit 60, are adjusted appropriately on the basis of the read results of the water content, the surface temperature and the luster, and thereby the above control parameters are properly controlled in accordance with the temperature alteration inside the apparatus and the temperature alteration of the respective parts.

Output Unit

As shown in FIG. 1, an output unit 70 is provided subsequently to the fixing process unit 60. The output unit 70 comprises an endless conveyance chain 74 wrapped about tensioning rollers 72A and 72B, and an output tray 76 in which a recording medium 14 after image formation is accommodated.

The recording medium 14 which has undergone the fixing process and which is output from the fixing process unit 60 is conveyed by the conveyance chain 74 and output to the output tray 76.

In the present embodiment, an inkjet recording apparatus which forms an image on one surface of a recording medium 14 is given as an example, but it is also possible to adopt a composition which forms an image on both surfaces of the recording medium 14. For example, a mode is also possible in which a second treatment liquid deposition unit is provided after the fixing process unit 60 and a second image formation unit, a second drying process unit and a second fixing process unit are provided thereafter. Further, it is also possible to adopt a mode that also includes an inverting unit which inverts the front surface and rear surface of the recording medium 14 after the fixing process and a conveyance unit which conveys the recording medium 14 after the inversion process to the treatment liquid application unit 30.

Structure of Inkjet Head

Next, one example of the structure of the inkjet heads 48M, 48K, 48C and 48Y provided in the image formation unit 40 will be described. The inkjet heads 48M, 48K, 48C and 48Y corresponding to the respective colors have a common structure, and therefore these inkjet heads are represented by an inkjet head (hereinafter, simply called "head") indicated by the reference numeral 100 below.

Figure 2:
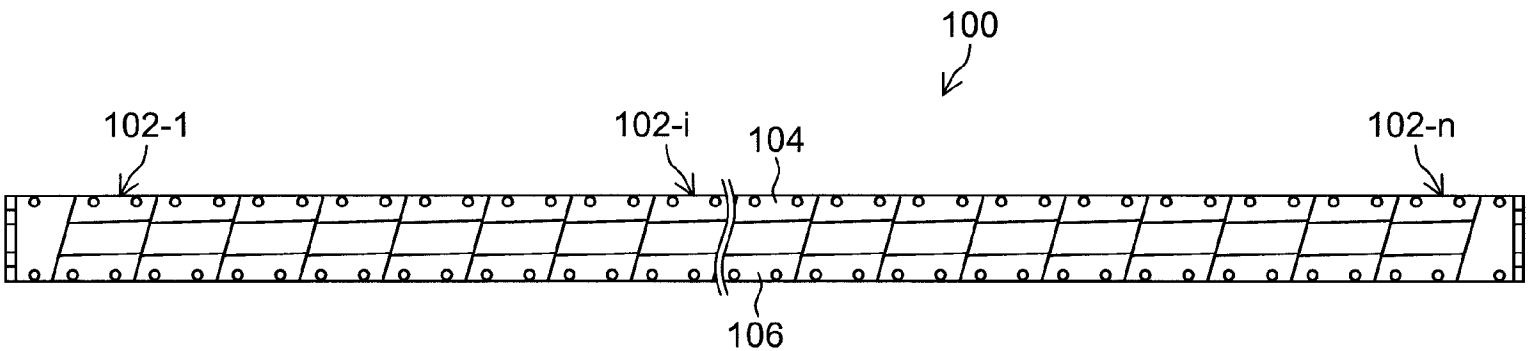
FIG. 2 is a plan view perspective diagram showing an example of the composition of an inkjet head.

FIG. 2 is a general schematic drawing of a head 100, and shows a view of a head 100 as viewed from a recording surface of a recording medium (a plan view perspective diagram of the head). The head 100 shown in FIG. 2 constitutes a multiple head by joining together n sub-heads 102-*i* (where i is an integer from 1 to n) in a row. Furthermore, the sub-heads 102-*i* are supported by head covers 104 and 106 from either side of the width direction of the head 100. It is also possible to constitute a multiple head by arranging sub-heads 102-*i* in a staggered configuration.

One example of the application of a multi-head constituted by a plurality of sub-heads is a full-line head which corresponds to the entire width of a recording medium. A full line head has a structure in which a plurality of nozzles (labeled with the reference numeral 108 in FIG. 3) are arranged through the length (width) of the recording medium in a main scanning direction, following a direction (main scanning direction) which is perpendicular to the direction of movement of the recording medium (sub-scanning direction). An image can be formed over the full surface of the recording medium by means of a so-called single-pass image recording method in which image recording is carried out by performing just one relative scanning action of a head 100 having this structure and a recording medium. The sub-heads 102-*i* have a substantially parallelogram-shaped planar shape, and an overlap section is provided between mutually adjacent sub-heads. An overlap section is a joint section between sub-heads, in which dots that are mutually adjacent in the alignment direction of the sub-heads 102-*i* (the left/right direction in FIG. 2; the main scanning direction X in FIG. 3) are formed by nozzles belonging to different sub-heads.

Figure 3:
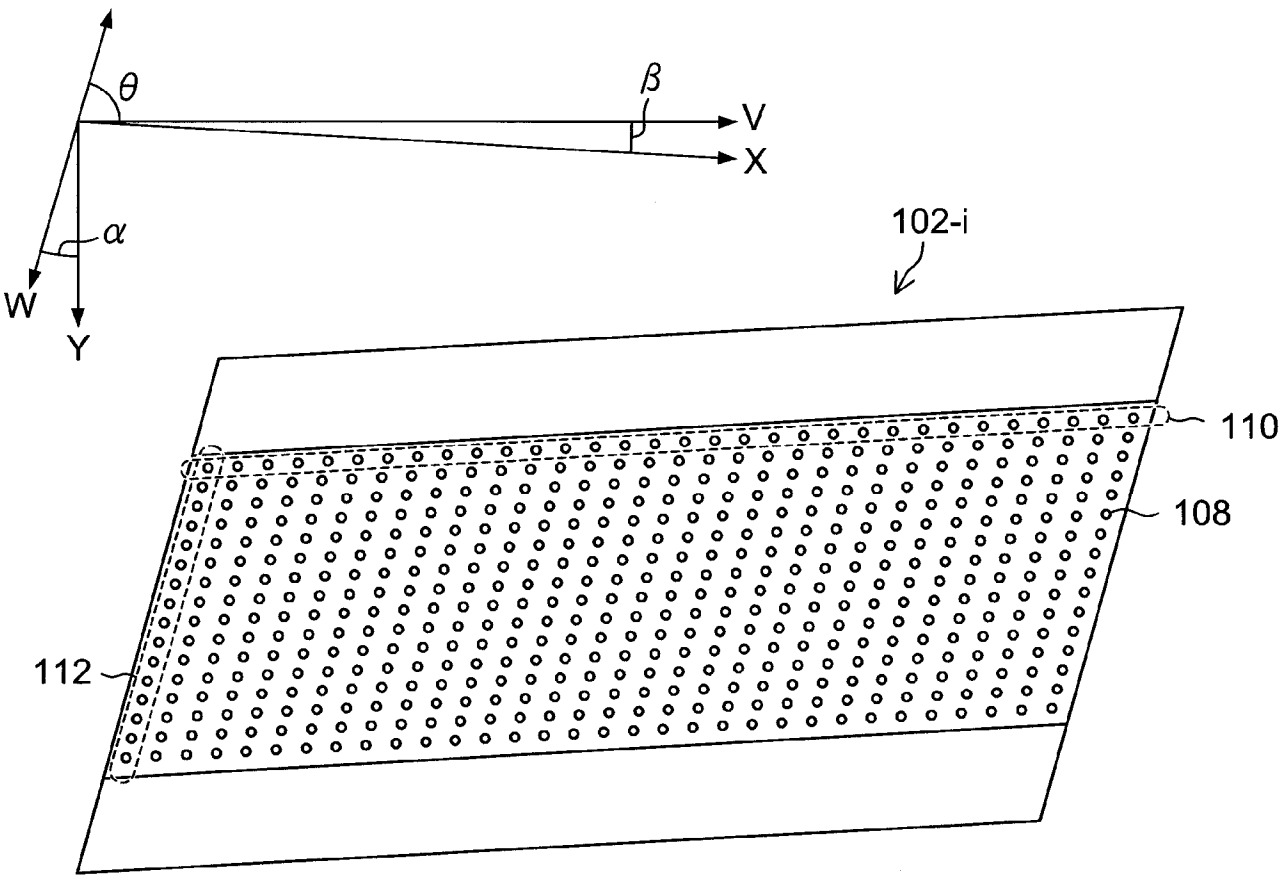
FIG. 3 is a plan diagram illustrating a nozzle arrangement in the inkjet head shown in FIG. 2.

FIG. 3 is a plan diagram showing a nozzle arrangement in a sub-head 102-*i*. As shown in FIG. 3, each sub-head 102-*i* has a structure in which nozzles 108 are arranged in a two-dimensional configuration, and a head which includes sub-heads 102-*i* of this kind is known as a so-called matrix head. The sub-head 102-*i* shown in FIG. 3 has a structure in which a plurality of nozzles 108 are arranged in a column direction W that forms an angle $\alpha$ with respect to the sub-scanning direction (the direction of relative movement of the recording medium 14 and the head 100) Y, and a row direction V that forms an angle $\beta$ with respect to the main scanning direction (the direction of arrangement of the sub-heads 102-*i*) X, thereby achieving a high density of the effective nozzle arrangement density in the main scanning direction X.

In FIG. 3, a nozzle group (nozzle row) arranged in the row direction V is labeled with reference numeral 110, and a nozzle group (nozzle column) arranged in the column direction W is labeled with the reference numeral 112. The matrix arrangement of the nozzles 108 is not limited to the example shown in FIG. 3, and nozzles 108 may also be arranged in a row direction following the main scanning direction X and a column direction which is oblique to the sub-scanning direction Y.

Figure 4:
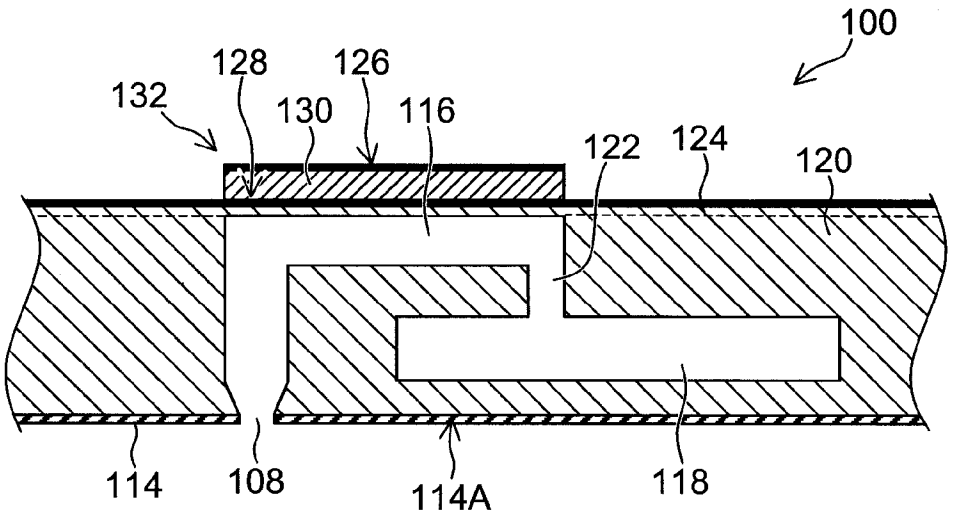
FIG. 4 is a cross-sectional diagram showing the inkjet head shown in FIG. 2.

FIG. 4 is a cross-sectional diagram showing the composition of a droplet ejection element of one channel which is the unit of the recording elements (namely, an ink chamber unit corresponding to one nozzle 108). As shown in FIG. 4, the head 100 according to the present embodiment has a structure in which a nozzle plate 114 in which nozzles 108 are formed, and a flow channel plate 120, and the like, in which flow channels such as pressure chambers 116 and a common flow channel 118, and the like, are formed are layered and bonded together. The nozzle plate 114 constitutes the nozzle surface 114A of the head 100 and a plurality of nozzles 108 which are connected respectively to the pressure chambers 116 are formed in a two-dimensional configuration therein.

The flow channel plate 120 is a flow channel forming member which constitutes side wall portions of the pressure chambers 116 and in which a supply port 122 is formed to serve as a restricting section (most constricted portion) of an individual supply channel for guiding ink to each pressure chamber 116 from the common flow channel 118. For the sake of the description, a simplified view is given in FIG. 4, but the flow channel plate 120 has a structure formed by one substrate or by layering together a plurality of substrates. The nozzle plate 114 and the flow channel plate 120 can be processed into a required shape by a semiconductor manufacturing process using silicon as a material.

The common flow channel 118 is connected to an ink tank (not shown), which is a base tank that supplies ink, and the ink supplied from the ink tank is supplied through the common flow channel 118 to the pressure chambers 116.

An individual electrode 126 and a lower electrode 128 are provided on a diaphragm 124 which constitutes a portion of the surface of the pressure chamber 116 (the ceiling face in FIG. 4) and a piezo actuator 132 having a structure in which a piezoelectric body 130 is sandwiched between the individual electrode 126 and the lower electrode 128 is joined thereto. If the diaphragm 124 is constituted by a metal thin film or a metal oxide film, then the diaphragm 124 also functions as a common electrode which corresponds to the lower electrodes 128 of piezoelectric actuators 132. In a mode in which a diaphragm is made from a non-conductive material, such as resin, a lower electrode layer made of a conductive material, such as metal, is formed on the surface of the diaphragm material.

When a drive voltage is applied to the individual electrode 126, the piezo actuator 132 deforms, thereby changing the volume of the pressure chamber 116. This causes a pressure change which results in ink being ejected from the nozzle 108. When the piezo actuator 132 returns to its original position after ejecting ink, the pressure chamber 116 is replenished with new ink from the common flow channel 118 via the supply port 122.

A high-density nozzle head according to the present embodiment is achieved by arranging a plurality of ink chamber units having a structure of this kind in a lattice configuration according to a prescribed arrangement pattern in a row direction V that forms an angle β with respect to the main scanning direction X and a column direction W that forms an angle α with respect to the sub-scanning direction Y, as shown in FIG. 3. If the pitch between adjacent nozzles in the sub-scanning direction is taken to be $L_s$, then this matrix arrangement can be treated as equivalent to a configuration where nozzles 108 are effectively arranged in a single straight line at a uniform pitch of $P=L_s/\tan\theta$ apart in the main scanning direction.

In the present embodiment, the piezo actuators 132 are used as the ink ejection force generating device which causes the ink to be ejected from the nozzles 108 in the head 100; however, it is also possible to employ a thermal method in which a heater is provided inside the pressure chamber 116 and the ink is ejected by using the pressure of the film boiling action caused by the heating action of this heater.

Description of Control System

Figure 5:
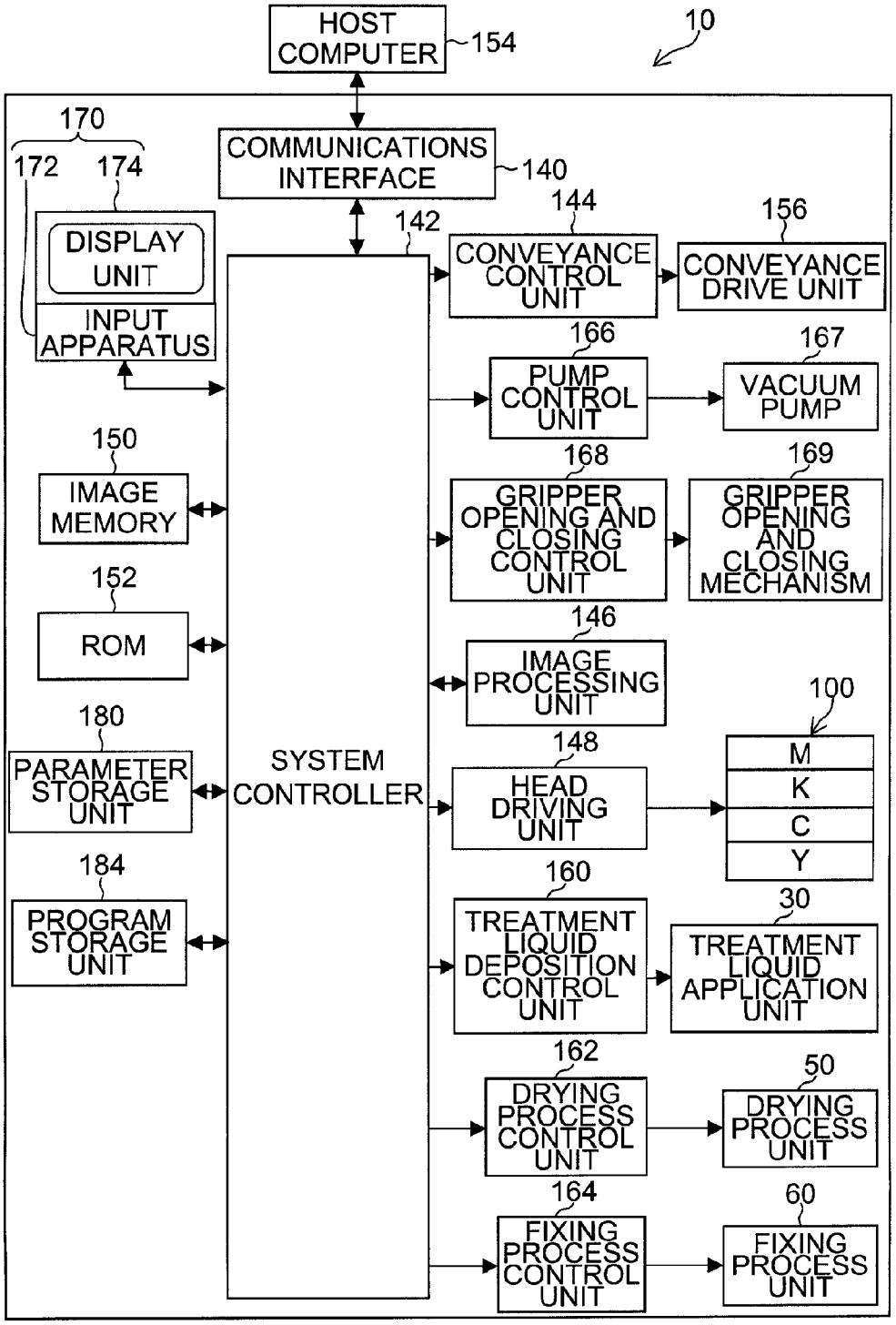
FIG. 5 is a principal block diagram showing a system configuration of the inkjet recording apparatus shown in FIG. 1.

FIG. 5 is a block diagram showing the approximate composition of a control system of the inkjet recording apparatus 10. The inkjet recording apparatus 10 comprises a communications interface 140, a system controller 142, a conveyance control unit 144, an image processing unit 146, and a head driving unit 148, as well as an image memory 150 and a ROM 152.

The communications interface 140 is an interface unit for receiving image data which is transmitted by a host computer 154. The communications interface 140 may employ a serial interface, such as a USB (Universal Serial Bus), or a parallel interface, such as a Centronics device. It is also possible to install a buffer memory (not illustrated) in the communications interface 140 for achieving high-speed communications.

The system controller 142 is constituted by a central processing unit (CPU) and peripheral circuits of same, and the like, and functions as a control apparatus which controls the whole of the inkjet recording apparatus 10 in accordance with prescribed programs, as well as functioning as a calculating apparatus which performs various calculations and also functioning as a memory controller for the ROM 152 and the image memory 150. In other words, the system controller 142 controls the various sections, such as the communications interface 140, the conveyance control unit 144, and the like, as well as controlling communications with the host computer 154 and read and writing to and from the image memory 150 and the ROM 152, and the like, and generating control signals which control the respective units described above.

The image data sent from the host computer 154 is input to the inkjet recording apparatus 10 via the communications interface 140, and prescribed image processing is carried out by the image processing unit 146. The image processing unit 146 is a control unit which has signal (image) processing functions for carrying out various processing to generate a signal for controlling printing from the image data, corrections and other processing, and which supplies the generated print data to the head drive unit 148. Required signal processing is carried out in the image processing unit 146 and the ejected droplet volume (droplet ejection volume) and the ejection timing of the head 100 are controlled via the head drive unit 148 on the basis of the image data. By this means, a desired dot size and dot arrangement are achieved. The head drive unit 148 shown in FIG. 5 may also include a feedback control system for maintaining uniform drive conditions in the head 100.

The conveyance control unit 144 controls the conveyance timing and conveyance speed of the recording medium 14 (see FIG. 1) on the basis of a print control signal generated by the image processing unit 146. The conveyance drive unit 156 in FIG. 5 includes motors which rotate the pressure drums 34 to 64 in FIG. 1, motors which rotate the transfer drums 32 to 62, a motor of the conveyance mechanism of the recording medium 14 in the paper supply unit 20, and a motor which drives the tensioning roller 72A (72B) of the output unit 70, and the like, and the conveyance control unit 144 functions as a driver of the motors described above.

The conveyance control unit 144 controls the operation of the paper pressing roller 46 (not shown in FIG. 5, see FIG. 1) which is provided in the image formation unit 40. For example, when the system control unit 142 obtains recording medium information, such as the thickness of the recording medium 14, the type of recording medium 14, and the like, the pressing force of the paper pressing roller 46 (the distance with respect to the outer circumferential surface 204 of the image formation unit 44) is altered suitably.

The image memory (primary storage memory) 150 comprises the functions of a temporary storage device for temporarily storing image data input via the communications interface 140, and the functions of a development area for various programs stored in the ROM 152 and a calculation work area for the CPU (for example, a work area for the image processing unit 146). A volatile memory (RAM) which can be read from and written to sequentially is used as the image memory 150.

The ROM 152 stores programs which is executed by the CPU of the system controller 142, and various data and control parameters, and the like, which are necessary for controlling the respective sections of the apparatus, and reading and writing of data are performed via the system controller 142. The ROM 152 is not limited to a memory such as a semiconductor element, and may also employ a magnetic medium, such as a hard disk. Furthermore, the storage unit may also comprise an external interface and use a detachable storage medium.

The in-line determination unit (not shown) including an in-line sensor 82 as shown in FIG. 1 is a processing block that includes a signal processing unit for carrying out prescribed signal processing, such as noise removal, amplification, waveform shaping, and the like, of the read signal output from the in-line sensor 82. The system controller 142 judges the presence or absence of ejection abnormalities in the head 100 on the basis of the determination signal obtained by the in-line determination unit.

The inkjet recording apparatus 10 also comprises a treatment liquid deposition control unit 160, a drying process control unit 162, and a fixing process control unit 164, which respectively control the operations of the treatment liquid application unit 30 including the treatment liquid application unit 36 (see FIG. 1), the drying process unit 50 including the drying process unit 56 (see FIG. 1) and a fixing process unit 60 including the heater 66 and fixing roller 68 (see FIG. 1), in accordance with instructions from the system controller 142.

The treatment liquid deposition control unit 160 controls the timing of treatment liquid application, as well as controlling the amount of treatment liquid applied, on the basis of print data obtained from the image processing unit 146. Furthermore, the drying process control unit 162 controls the timing of the drying process in the drying processing unit 56, as well as controlling the process temperature, air flow volume, and the like, and the fixing process control unit 164 controls the temperature of the heater 66 (see FIG. 1), as well as the application pressure of the fixing roller 68 (see FIG. 1).

The pump control unit 166 controls the vacuum pump 167 which generates suction pressure for vacuum-suctioning the recording medium 14 (see FIG. 1) on the pressure drum 44. For example, when the recording medium 14 which has undergone prescribed processing is supplied to the image formation drum 44, the vacuum pump 167 connected to the vacuum flow channel of the image formation drum 44 is operated and a vacuum (negative pressure) is generated in accordance with the type and size and the bending rigidity of the recording medium 14. More specifically, when the system controller 142 acquires control information with respect to the vacuum pump 167, such as information about the type of recording medium, this control information is sent to the pump control unit 166. The pump control unit 166 sets the suction pressure in accordance with the control information, and controls the on/off switching and the generated pressure of the vacuum pump 167 in accordance with this setting.

For example, if using a recording medium having low bending rigidity, such as thin paper, the suction pressure is set lower than standard, and if using a recording medium having high bending rigidity, such as thick paper, the suction pressure is set higher than standard. Furthermore, depending on the thickness of the recording medium, if a thick recording medium is used, then the suction pressure is set higher than standard and if a thin recording medium is used, then the suction pressure is set lower than standard. A data table is desirably created by associating the type of recording medium (e.g. thickness and bending rigidity) with the suction pressure, and this table is desirably stored in a prescribed memory (for example, the ROM 152 in FIG. 5).

FIG. 5 shows only one vacuum pump 167, but a mode is also possible in which a plurality of vacuum pumps 167 are connected to the image formation drum 44. For example, it is also possible to provide a switching device, such as a control valve, at an intermediate point of the vacuum flow channel, in such a manner that one vacuum pump is switched selectively, and it is also possible to divide the medium holding section into a plurality of areas and to connect the vacuum pumps 167 to the divided areas respectively.

A gripper opening and closing control unit 168 controls a gripper opening and closing mechanism 169 (the gripper opening and closing mechanism 214 shown in FIG. 6, and the like) which operates (opens and closes) the grippers 80 provided in each of the pressure drums 34, 44, 54, 64, in accordance with the transfer of the recording medium 14. For example, the grippers of the transfer drum 42 and the grippers 80 of the image formation drum 44 are arranged at separate positions in the width direction of the recording medium 14, and have a structure in which a grippers 80 of the image formation unit 44 enter in between the grippers of the transfer drum 42 in a state where the grippers of the transfer drum 42 are gripping the recording medium 14, thereby achieving a composition whereby the recording medium 14 can be gripped simultaneously by both the grippers of the transfer drum 42 and the grippers 80 of the image formation unit 44.

When the recording medium 14 is transferred from the transfer drum 42 to the image formation unit 44, the leading end portion of the recording medium 14 gripped by the grippers of the transfer drum 42 is also gripped by the grippers 80 of the image formation unit 44, and when the grippers of the transfer drum are subsequently opened, the recording medium 14 is gripped only by the grippers 80 of the image formation unit 44 and is transferred from the transfer drum 42 to the image formation unit 44. A similar system is employed for transferring the recording medium 14 between the other transfer drums 32, 52, 62 and the pressure drums 34, 54, 64.

The inkjet recording apparatus 10 described in the present embodiment includes, as a user interface 170, an input apparatus 172 for the operator (user) to make various inputs and a display unit (display monitor) 174. The input apparatus 172 may employ various modes, such as a keyboard, mouse, touch panel, buttons, or the like. By operating the input apparatus 172, an operator can perform actions such as inputting print conditions, selection the image quality mode, inputting and editing additional information, searching for information, and the like, and can confirm various information such as input content, search results, and the like, via the display on the display unit 174. This display unit 174 also functions as a device which displays warnings, such as error messages.

The inkjet recording apparatus 10 described in the present embodiment comprises a paper floating determination sensor (not illustrated) for determining an amount of floating of the recording medium 14 which is fixed and held on an image formation drum 44. A mode using an optical sensor is given as an example of the composition of the paper floating detection sensor. For example, it is possible to employ a mode in which a light transmitter and a light receptor are disposed on either side of the image formation unit 44, and to emit inspection light from the light transmitter (inspection light source) toward the light receptor (photosensor). Instead of an optical sensor, it is also possible to employ a sensor based on an ultrasonic sensor, a reflective photointerruptor, a transmissive photointerruptor system fitted with a lever (actuator), or the like, and it is also possible to employ a composition in which a wire is stretched in the axial direction of the image formation unit 44 and the change of tension in the wire due to contact with the recording medium 14 is determined.

Upon receiving information about the amount of investigation light received by the light receptor, the system controller 142 judges whether or not the amount of floating up of the recording medium is greater than a prescribed amount by comparing the amount of received light with a prescribed threshold value. If it is judged that the amount of floating of the recording medium 14 held securely on the image formation unit 44 is greater than the prescribed amount, then a command signal is sent from the system control unit 142 to the conveyance control unit 144 in such a manner that the conveyance of the recording medium 14 is halted before the recording medium 14 enters into the image formation region of the head 100. Furthermore, the system control unit 142 displays a notification to this effect on the display unit 174. A desirable mode is one where threshold values corresponding to the thickness and type of recording medium 14 are determined and stored in advance, and the threshold value is switched in accordance with information about the recording medium 14.

Image Formation Drum

Next, the image formation drum 44 employed in the image formation unit 40 shown in FIG. 1 is described in detail.

General Composition of Image Formation Drum

Figure 6:
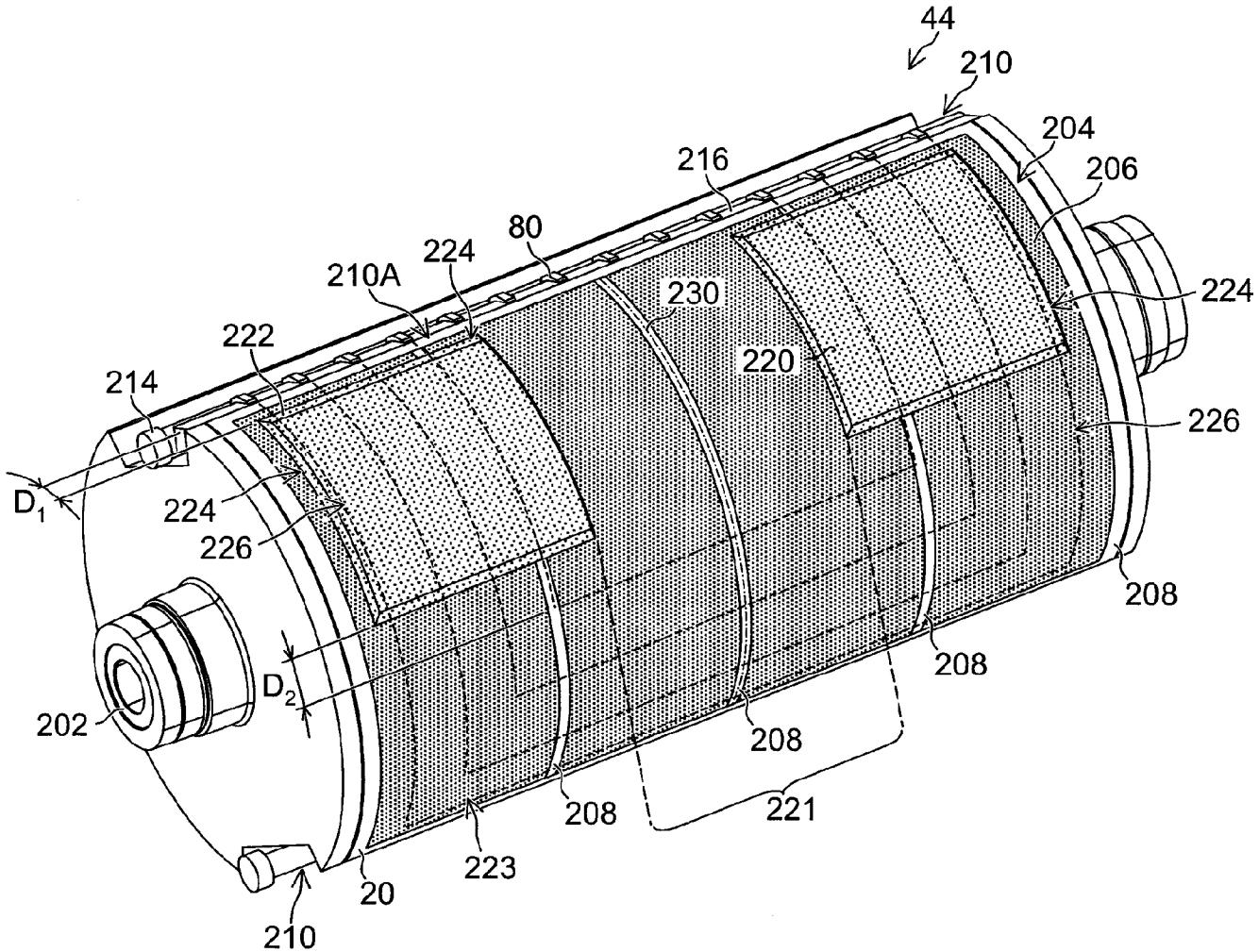
FIG. 6 is a perspective diagram showing an approximate structure of an image formation drum employed in the inkjet recording apparatus shown in FIG. 1.
Figure 7:
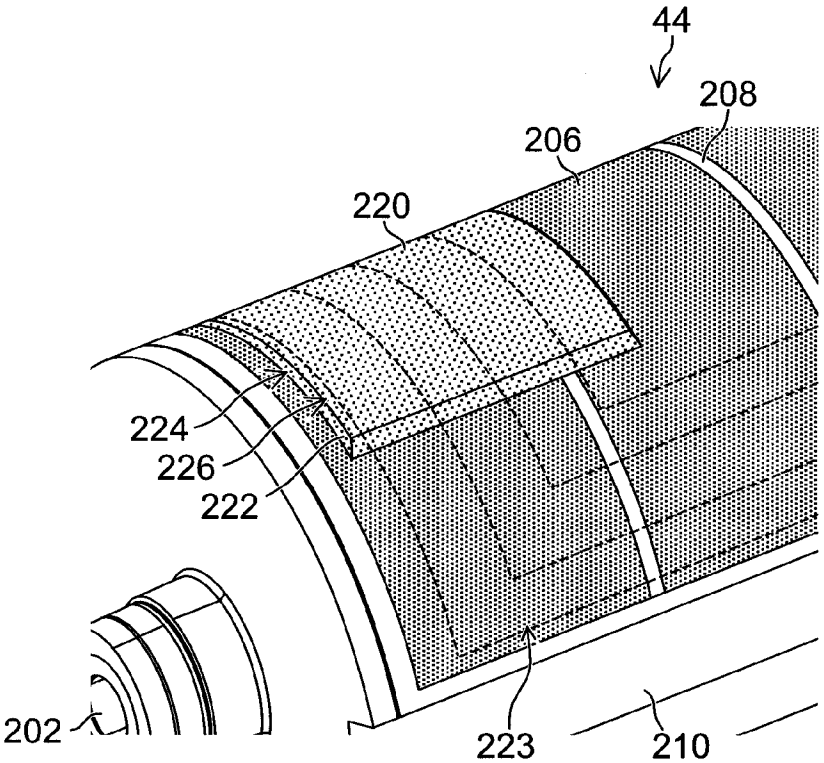
FIG. 7 is a partial enlarged diagram of the vicinity of a position where a paper trailing end portion is fixed in the image formation drum shown in FIG. 6.

FIG. 6 is a perspective diagram showing the whole structure of the image formation drum 44, and FIG. 7 is a diagram showing an enlarged view of the vicinity of the trailing end position of the recording medium 14. The image formation drum 44 shown in FIG. 6 is a rotating member which is coupled to a rotating mechanism (not illustrated) and is composed so as to be rotatable about a rotational shaft 202 supported by bearings (not illustrated), due to the operation of the rotating mechanism. Furthermore, the outer circumferential surface 204 of the image formation drum 44 functions as a medium supporting surface which supports a recording medium 14 (see FIG. 1) from the rear surface side, and has a medium supporting region 206 in which a plurality of suction holes for generating a suction pressure (negative pressure) to act on the recording medium 14 (not depicted individually in FIG. 6, but depicted individually by reference numeral 322 in FIG. 11) are provided. In the medium supporting region 206 indicated by the dot hatching in FIG. 6, band-shaped closed sections 208 where no suction holes are formed are provided through approximately ½ the total circumferential length of the drum, following the circumferential direction, and the rear sides of the restrictor sections (described hereinafter; not shown in FIG. 6 and indicated by reference numeral 362 in FIG. 12) are closed off by these closed sections 208. A medium supporting region having the same structure is also formed on the rear side which is not depicted in the perspective diagram shown in FIG. 6.

FIG. 6 shows a mode in which closed sections 208 are provided in the substantially central portion and both edge portions in the axial direction of the image formation drum 44, and in intermediate positions between the central portion and the respective edge portions in the axial direction. The installation positions of the closed sections 208 are determined appropriately in accordance with the structure of the vacuum flow channels (the positions of the restrictor sections described below).

A vacuum flow channel for suctioning which connects with suction holes provided in the medium supporting region 206 is provided inside the image formation drum 44 shown in FIG. 6. This vacuum flow channel is connected to a vacuum pump (not illustrated in FIG. 6 and indicated by reference numeral 167 in FIG. 5) which is provided externally to the image formation drum 44, via tubes provided in the side face of the image formation drum 44, a vacuum tube system such as joints (not illustrated), and vacuum flow channels (not illustrated) provided inside the rotational shaft 202 of the image formation drum 44. When a vacuum (negative pressure) is generated by operating the vacuum pump, a suction pressure is applied to the recording medium 14 via the suction holes and the vacuum flow channels, and the like. In other words, the image formation drum 44 is composed in such a manner that a recording medium 14 is held securely on the circumferential surface (medium supporting surface) 104 by a vacuum (air) suctioning method.

Recess sections 210 are formed in two locations on the outer circumferential surface of the image formation drum 44, the recess sections 210 each having the same length as the entire length of the drum in this axial direction. The two recess sections 210 are positioned approximately 180° apart in the direction of rotation and at symmetrical positions with respect to the axle of the image formation drum 44.

A plurality of grippers 80 which function as gripping devices to grip the leading end portion of a recording medium 14, and a gripper opening and closing mechanism 214 for opening and closing the plurality of grippers 80 are disposed in each recess section 210. The grippers 80 have a hook shape (an approximate L shape) and grip the leading end portion of a recording medium 14 by sandwiching the leading end portion of the recording medium 14 against a hook base 216 which supports the leading end portion of the recording medium 14 from the rear side. The plurality of grippers 80 having this structure are disposed equidistantly in the axial direction, and are also disposed through a length corresponding to the maximum width of the recording medium 14, and perform an opening and closing operation by means of a gripper opening and closing mechanism 214. The plurality of grippers 80 are accommodated in the recess sections 210 so as not to project from the outer circumferential surface 204 of the image formation drum 44 and thus avoid collision with the paper pressing roller 46 (see FIG. 1).

Description of Level Difference Coating Sections

Next, a level difference coating section 220 provided in the medium supporting region 206 of the image formation drum 44 will be described. A level difference coating section 220 is provided in the medium supporting region 206 of the image formation drum 44 shown in FIG. 6, on both sides of the central portion 221 in the axial direction. The level difference coating sections 220 are coating films having a prescribed thickness, formed by carrying out a coating process on the surface where the openings of the suction holes are provided (the surface where the rear surface of the recording medium 14 is supported). In other words, the image formation drum 44 has level difference coating sections 220 of larger diameter than the central portion 221 where the suction holes are exposed, and in the portions of the drum where the level difference coating sections 220 are provided, the suction holes are covered up. The thickness of the level difference coating sections 220 is desirably not less than 50 μm and not more than 500 μm.

The level difference coating sections 220 shown in FIG. 6 are formed with graduated coating sections in which the edge sections 222 are chamfered. FIG. 6 shows a mode where the thickness of the graduated coating sections (edge sections) 222 changes smoothly and continuously, but it is also possible to adopt a mode where the thickness changes in a stepwise fashion or a curved shape. The material used for the applied material of the level difference coating sections 220 is a material that can be cured (or semi-cured) by heat treatment, a drying process, light irradiation process, or the like, and has a prescribed rigidity and a prescribed bending strength after curing (or semi-curing). One example of a material used as the level difference coating sections 220 is a material which contains ceramic or resin.

The level difference coating sections 220 are arranged so as to be separated by a gap of $D_1$ from an edge section 210A of the recess section 210 in the circumferential direction of the image formation drum 44. Furthermore, the level difference coating sections 220 are arranged so as to be separated by a gap of $D_2$ from the trailing end position 223 of a recording medium 14 of the minimum size in the circumferential direction of the image formation drum 44. In other words, the image formation drum 44 has a leading end non-level difference section having the same diameter as the central section 221 and having a length of $D_1$, between the edge section 210A (grippers 80) of a recess section 210 and the level difference coating sections 220, in the circumferential direction, and also has a trailing end non-level difference section having the same diameter as the central portion 221 and having a length of $D_2$, between the trailing end of the level difference coating sections 220 and the trailing end position of the recording medium in the direction of conveyance.

More specifically, in the conveyance direction (the circumferential direction of the image formation drum 44), the leading end of the recording medium 14 is gripped by grippers 80, and the leading end region and the trailing end region of the recording medium 14 are held by suction. Here, the "leading end region" of the recording medium 14 is a region having a length of not less than 2% and not more than 10% of the total length of the recording medium 14 from the leading end of the recording medium 14 in the direction of movement of the recording medium 14 (the circumferential direction of the image formation drum 44) and the "trailing end region" of the recording medium 14 is a region having a length of not less than 2% and not more than 15% from the trailing end of the recording medium 14 in the direction of movement of the recording medium 14 (the circumferential direction of the image formation drum 44).

Furthermore, the level difference coating sections 220 are provided on either side of the central section 221 which includes a central position 230 in the axial direction of the image formation drum 44. The central section 221 is a vacuum suction region in which the suction holes are exposed, and the central position of the central section 221 coincides with the central position 230 in the axial direction of the image formation drum 44 and the length of the central section 221 in the axial direction of the image formation drum 44 is not more than ⅓ and desirably not more than ¼ of the total length of the medium supporting region 206 in the axial direction of the image formation drum 44.

On the other hand, either end 224 of each level difference coating section 220 in the axial direction of the image formation drum 44 is situated to the outside of the respective end sections 226 of a recording medium 14 of maximum size, in the axial direction. The level difference coating sections 220 which are provided on either side of the central section 221 shown in FIG. 6 have a common structure, but they may also have different structures (shapes), provided that the aforementioned conditions are satisfied.

The level difference coating sections 220 according to the present embodiment are composed as non-suctioning regions where the suction holes are closed off, but from the viewpoint of ensuring the overall suctioning force, they may also be provided with suction holes of a smaller number than those in the central section 221, so as to provide complementary vacuum suctioning. Of course, it is also possible to adopt a structure where a portion of each of the suction holes is closed off (a structure where half of each suction hole is closed off, for instance).

Figure 8A:
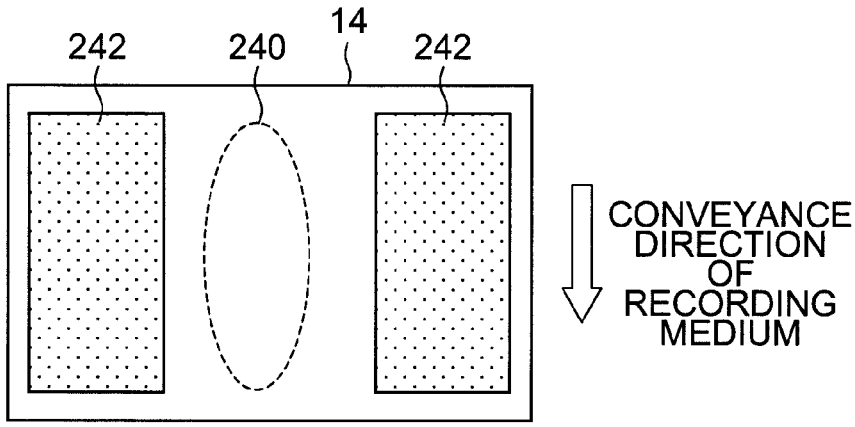
FIGS. 8A to 8C are diagrams illustrating the occurrence of wrinkles of paper during pressing by a paper pressing roller.
Figure 8B:
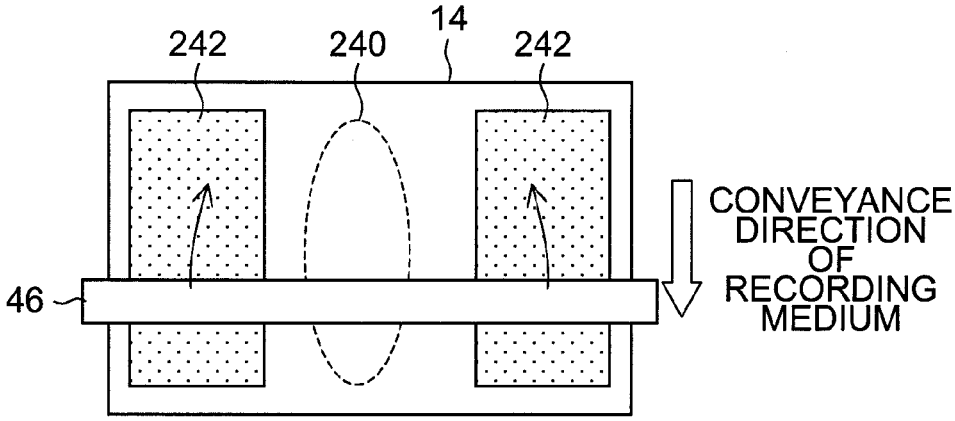
Figure 8C:
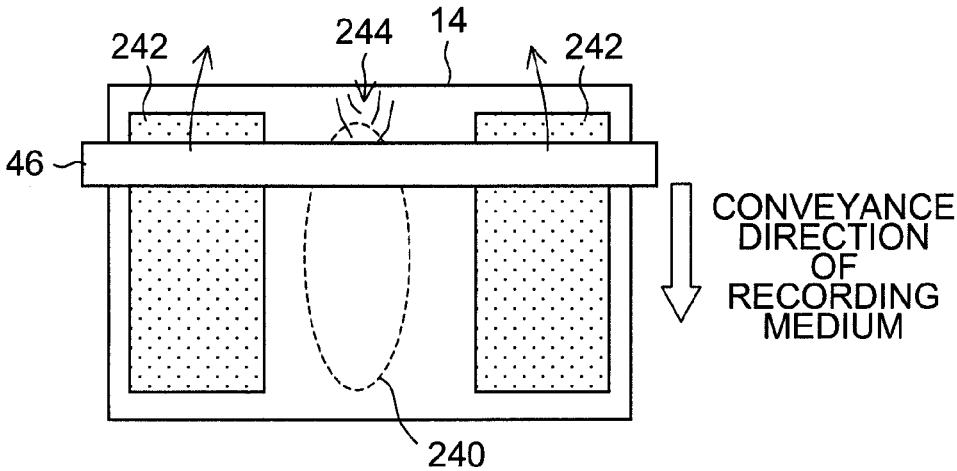

Next, wrinkles which occur when the recording medium 14 is caused to make tight contact with the medium supporting region 206 of the image formation drum 44 will be described with reference to FIGS. 8A to 8C. FIG. 8A shows a schematic view of a state where printing on one surface has been completed on a recording medium 14 on which double-surface printing is to be carried out. In the recording medium 14 shown in FIGS. 8A to 8C, the central region in the width direction of the recording medium 14 (the region indicated by the dotted line) which is perpendicular to the direction of conveyance of the recording medium indicated by the downward arrow in the drawings, is a non-image region 240 where no image is formed, and both sides of the non-image region 240 are image forming regions 242 where an image is formed.

In the recording medium 14 shown in FIG. 8A, the image forming regions 242 into which ink permeates deform greatly, and the non-image forming region 240 deforms hardly at all. As shown in FIG. 8B, when forming an image on the rear surface of the recording medium 14 of which both sides in the width direction have deformed greatly, if the recording medium 14 is caused to make tight contact with the medium supporting region 206 of the image formation unit 44 by using the paper pressing roller 46, then slackness (the deformed portion) of the recording medium 14 is gradually caused to travel toward the central portion. In FIG. 8B, the direction in which the slackness of the recording medium 14 travels is indicated by arrows. By this means, a larger amount of slackness accumulates toward the trailing end portion of the recording medium 14, and if the accumulated slackness exceeds an allowable range, then wrinkles 244 occur in the trailing end portion of the recording medium 14, as shown in FIG. 8C.

Figure 9A:
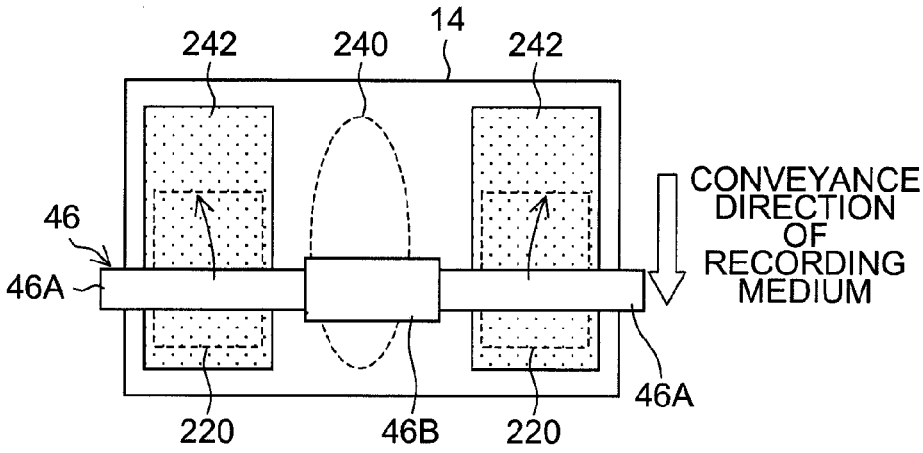
FIGS. 9A and 9B are diagrams for illustrating beneficial effects of the present invention.
Figure 9B:
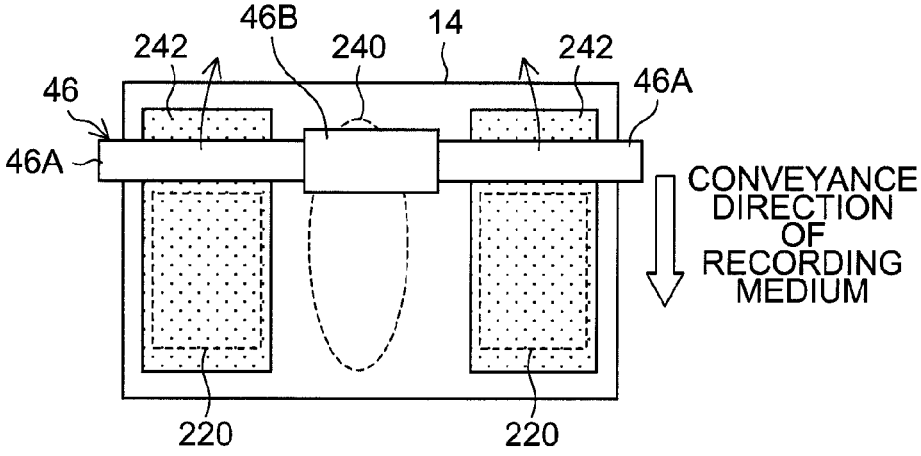

FIGS. 9A and 9B are diagrams illustrating the action and beneficial effects of a case where the image formation drum 44 shown in the present embodiment is used, and depicts a schematic view of processing for causing a recording medium 14 to make close contact with the medium supporting region 206 of the image formation drum 44 (see FIG. 6). As shown in FIG. 9A, when the recording medium 14 of which both sides in the width direction have deformed greatly (for example, a medium which has completed printing on only one surface in double-side printing) is caused to make tight contact with the medium supporting region 206 of the image formation drum 44, then even if the recording medium 14 is pressed from above by using the paper pressing roller 46, since the level difference coating sections 220 corresponding to the image forming regions 242 have a greater circumferential length than the uncoated section which corresponds to the non-image region 240, the slackness caused by elongation of the recording medium 14 is pulled toward the outside (the direction in which the slackness is pulled is indicated by the arrows), the slackness is not drawn toward the central portion, and therefore accumulation of slackness is not liable to occur.

On the other hand, since there is no level difference coating section 220 under the trailing end region of the recording medium 14 (the trailing end region of the recording medium 14 is not mounted on the level difference coating sections 220) and the trailing end region of the recording medium 14 is vacuum suctioned, then the slackness caused by elongation of the trailing end region of the recording medium 14 is caused to travel toward the central portion and this slackness accumulates, but not to the extent of forming wrinkles, as shown in FIG. 9B. The arrows in FIG. 9B indicate the directions in which the slackness is caused to travel in the trailing end region of the recording medium 14.

Furthermore, the paper pressing roller 46 shown in FIGS. 9A and 9B has a structure in which a diameter differential corresponding to the height of the level difference coating sections 220 is provided between the central portion 46B and the respective side portions 46A (corresponding to the level difference coating sections 220) of the paper pressing roller 46 in the lengthwise direction. By means of this structure, the respective side portions of the recording medium 14 which are positioned over the level difference coating sections 220 and the central portion of the recording medium 14 which is not positioned over the level difference coating sections 220 can be pressed uniformly against the medium supporting region 206 of the image formation drum 44.

In the inkjet recording apparatus 10 having a composition of this kind, level difference coating sections 220 having a greater diameter than the central section 221 are provided to either side of the central section 221 in the axial direction of the image formation drum 44, of the medium supporting region 206 of the image formation drum 44, and therefore when a recording medium 14 having large deformation is caused to make tight contact with the medium supporting region 206 of the image formation drum 44, the level difference coating sections 220 pull the slackness caused by elongation of the recording medium 14 toward to the outer side, and this slackness is not drawn toward the center in the width direction of the recording medium 14 (the direction substantially parallel to the axial direction of the image formation drum 44), thus preventing the occurrence of wrinkles.

On the other hand, since the central region, the leading end region and the trailing end region of the recording medium 14 are vacuum suctioned, then floating up of the leading end portion of the recording medium 14 is prevented and the trailing end of a recording medium 14 having high rigidity does not become detached.

Vacuum Suction Apertures

Next, the vacuum suction structure employed in the image formation drum 44 shown in the present embodiment will be described. The vacuum suction structure described below is no more than one example, and it is also possible to adopt other compositions. Of course, it is also possible to adopt another suction method, such as electrostatic attraction, or the like.

Figure 10:
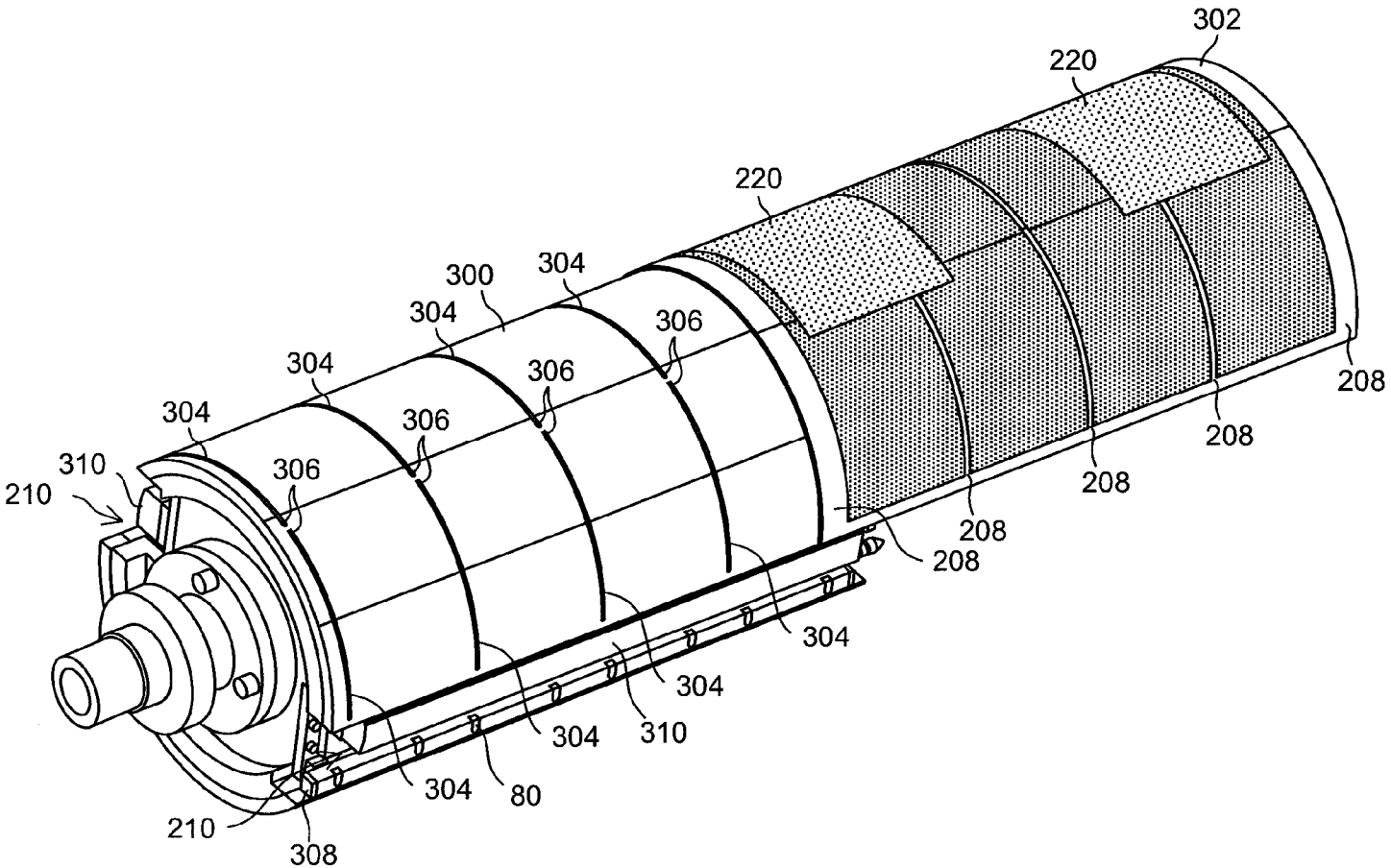
FIG. 10 is an exploded perspective diagram of the image formation drum shown in FIG. 6.

FIG. 10 is an exploded perspective drawing of the image formation unit 44 shown in FIG. 6. As shown in FIG. 10, the image formation drum 44 has a structure in which two suction sheets 302 each corresponding to half the circumference of a main body section 300 are wrapped respectively about half the circumference of the main body section 300. Five drum suction grooves 304 (the right end drum suction groove is not depicted in FIG. 10) are provided in the main body section 300 following the circumferential direction, the drum suction grooves 304 being arranged equidistantly in the axial direction. The drum suction grooves 304 have a structure which is divided in two in the circumferential direction, and drum suction holes 306 are provided inside each drum suction groove 304.

In the main body section 300 shown in FIG. 10, a drum suction hole 306 is provided at one end of each drum suction groove 304 (the end on the adjacent sides of two drum suction grooves which are aligned in the circumferential direction). The drum suction holes 306 are connected to vacuum flow channels provided inside the main body section 300, and are connected with the vacuum pump 167 (see FIG. 5) provided externally to the image formation drum 44 via the vacuum flow channels. When the vacuum pump 167 is operated, a vacuum (negative pressure) is generated in the drum suction holes 306 and the drum suction grooves 304.

As described previously, recess sections 210 are provided in two positions in the main body section 300. In each of the recess sections 210, a fixing section 308 which sandwiches and fixes the end portion on the leading end side of a suction sheet 302 bent into an L shape is provided in the edge portion of the side where the grippers 80 are provided (the leading end side of the recording medium 14), and furthermore, a suction mechanism 310 which pulls and fixes the trailing end of a suction sheet 302 so as to make tight contact with the outer circumferential surface of the main body section 300 is provided in the edge portion on the opposite side to the side where the grippers 80 are provided (namely, the side of the trailing end of the recording medium 14). Each suction sheet 302 is aligned in position with the main body section 300 in such a manner that the openings of the drum suction grooves 304 formed in the main body section 300 are closed off by the closed sections 208 in the suction sheet 302, and the leading end side of the suction sheet 302 is inserted into and fixed by the fixing section 308 and the trailing end side of the suction sheet 302 is pulled in the circumferential direction by the suction mechanism 310, thereby causing the suction sheet 302 to make tight contact with the main body section 300.

Figure 11:
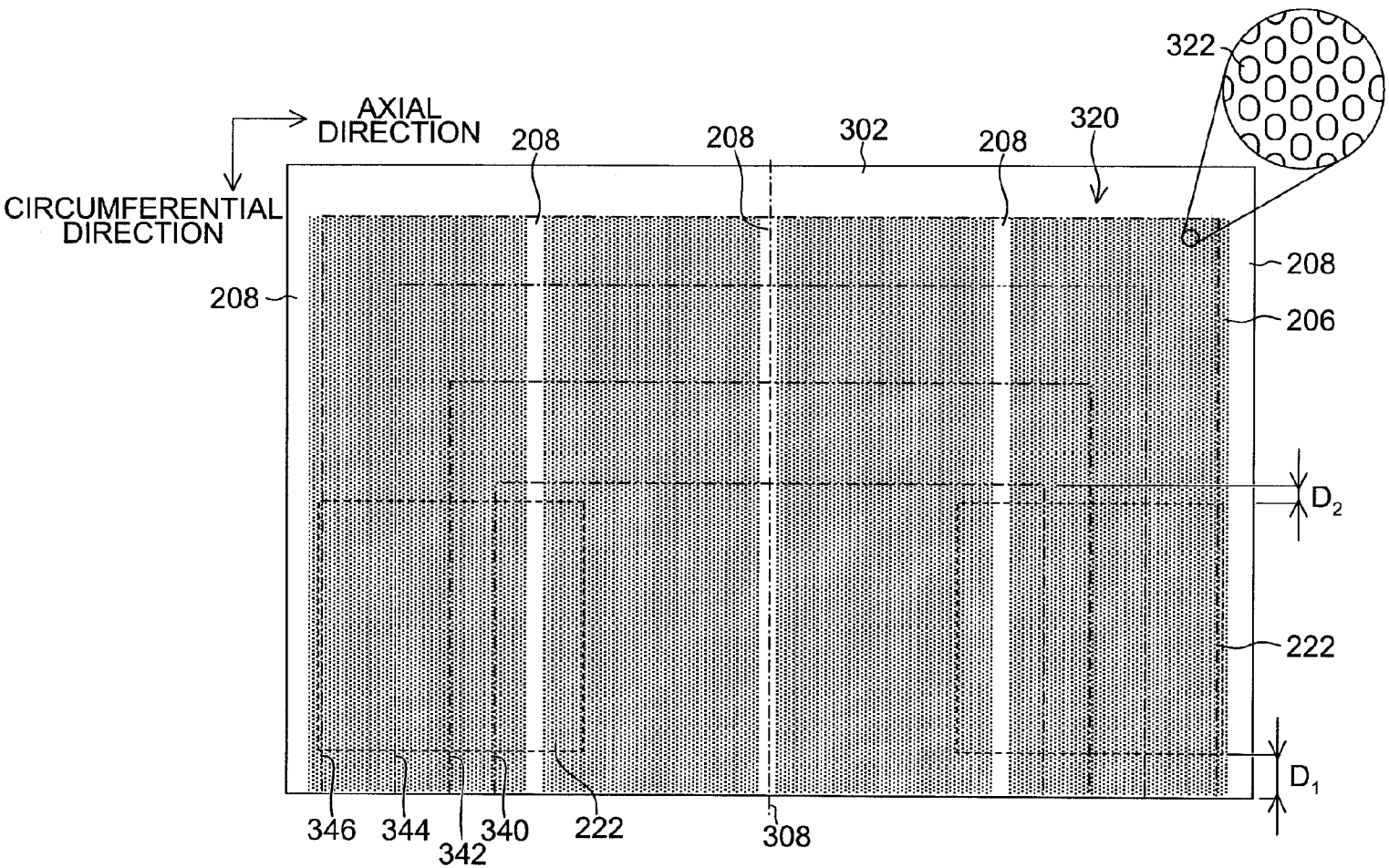
FIG. 11 is a projected diagram showing the structure of the front surface side of the suction sheet shown in FIG. 10.

Next, the structure of the suction sheet 302 will be described in detail. FIG. 11 is a projected diagram of a suction sheet 302 and depicts a surface which suctions and holds a recording medium 14. The horizontal direction in FIG. 11 is the axial direction and the vertical direction is the circumferential direction. The lower side in FIG. 11 is the leading end side in the conveyance direction of the recording medium 14, and the position indicated by the dotted line (alternate long and short dash line) and labeled with reference numeral 308 is the central position of the suction sheet 302 (medium supporting region 206) in the axial direction of the image formation drum 44.

The recording medium holding surface 320 of the suction sheet shown in FIG. 11 comprises a medium supporting region 206 where a plurality of suction holes 322 are provided, and band-shaped closed sections 208 where no suction holes 322 are provided.

Furthermore, the level difference coating sections 220 described above (indicated by dotted lines) are provided in the medium supporting region 206. The suction holes 322 have an elongated shape in order to increase the opening ratio, as shown by the expanded view shown in the top right part of FIG. 11.

Furthermore, the suction holes 322 are arranged in a staggered configuration so as to be arranged at high density. To give one example, the suction holes 322 each have a length of 2 mm in the vertical direction in FIG. 11 and a length of 1.5 mm in the horizontal direction. The ratio of the length in the horizontal direction with respect to the length in the vertical direction is desirably not less than 0.5 and not more than 1.0, and more desirably, not less than 0.7 and not more than 0.9. In order to raise the opening ratio of the suction sheet 302, a desirable mode is one where the opening shape of the suction holes 322 is a polygonal shape, such as a hexagonal shape. Furthermore, it is desirable for hexagonally shaped suction holes 322 to be arranged in a honeycomb configuration.

The rectangular regions 340, 342, 344 and 346 surrounded by the double-dotted lines (alternate long and two short dashes lines) in FIG. 11 indicate the suction regions for respective sizes of the recording medium 14 which is used. For example, reference numeral 340 corresponds to quarter Kiku size (469 mm×318 mm), reference numeral 342 corresponds to quarter Shiroku size (545 mm×394 mm), reference numeral 344 corresponds to half Kiku size (636 mm×469 mm), and reference numeral 346 corresponds to half EU size (520 mm×720 mm). A thin plate made of metal such as stainless steel having a thickness of approximately 0.1 mm to 0.5 mm is used for the suction sheet 302. By using a thin metal sheet of this kind, a corresponding flexibility and a prescribed rigidity are ensured when the suction sheet is wrapped and fixing about the curve shape of the outer circumferential surface of the main body section 300. If using a material other than stainless steel, the sheet is designed to a suitable thickness by taking account of the rigidity and bending strength of the material used.

Figure 12:
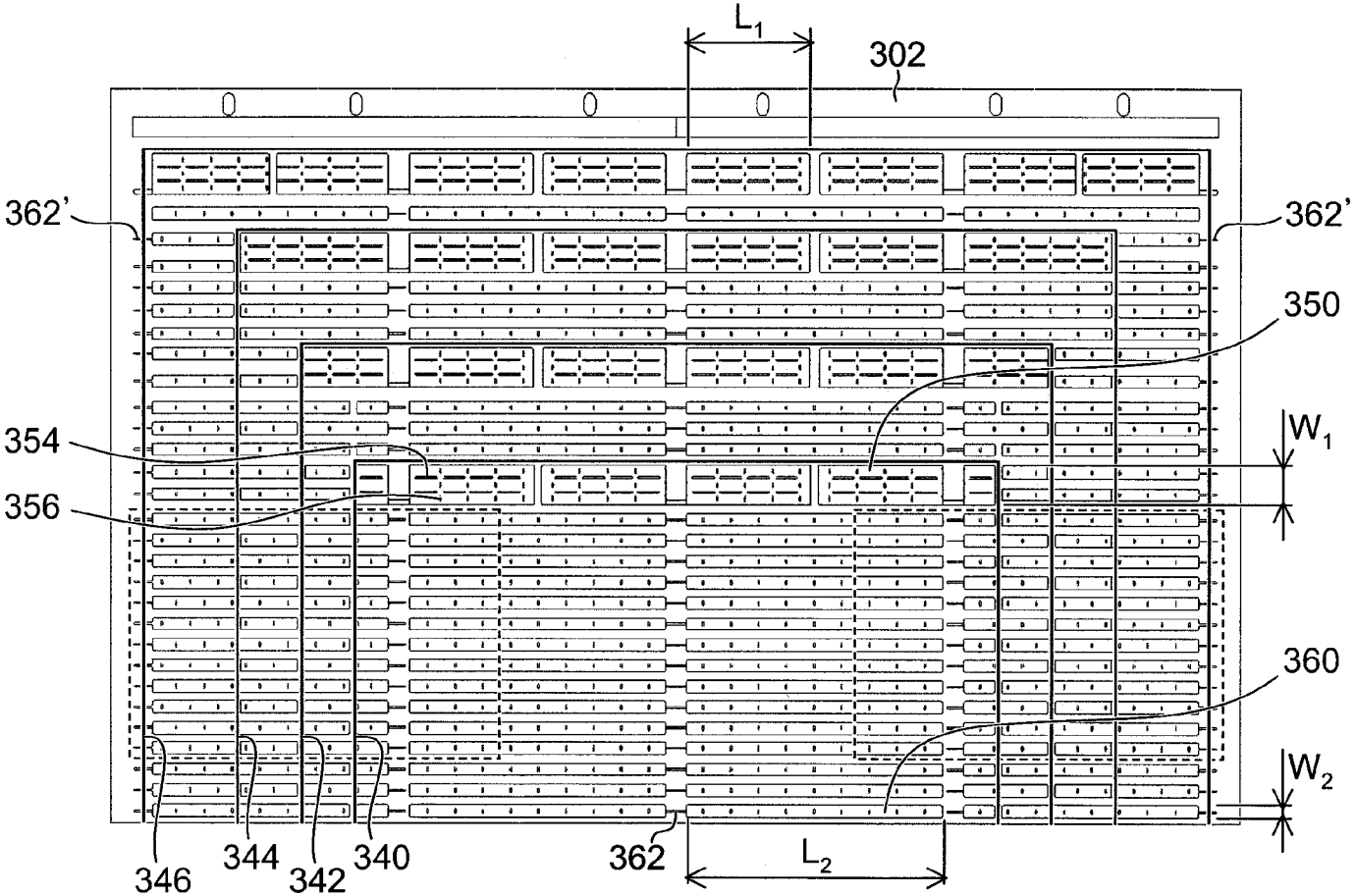
FIG. 12 is a projected diagram showing the structure of the rear surface side of the suction sheet shown in FIG. 10.

FIG. 12 is a planar projection diagram showing the structure of the surface (rear surface) of the suction sheet 302 which makes contact with the main body section 300. As shown in FIG. 12, a lot of suction grooves 350, 360 are provided inside the medium supporting region 206, and these suction grooves 350, 360 are arranged so as to correspond to four different sizes of recording media, which are depicted by the thick frames labeled with the reference numerals 340 to 346.

The length $W_1$ in the groove width circumference direction of the suction grooves 350 which are provided in positions corresponding to the trailing end portion of the recording medium 14 (positions in the vicinity of the thick frame) is greater than the groove width $W_2$ of the suction grooves 360 which are provided in positions corresponding to portions other than the trailing end portion of the recording medium 14 (the center and lower side in the drawing). According to this structure, it is possible to increase the amount of air at the trailing end portion of the recording medium 14 with respect to the central portion and the leading end portion, and hence floating or curling of the trailing end portion of the recording medium 14 is prevented effectively. On the other hand, the groove length of the suction grooves 350 (the length in the axial direction) $L_1$ is approximately ½ of the groove length $L_2$ of the suction grooves 360.

The suction grooves 350 and the suction grooves 360 have a structure in which one end thereof in the axial direction is closed off, while a restrictor section 362 is provided at the other end. Furthermore, the respective ends of each restrictor section 362 arranged outside the both end portions in the axial direction are connected to different suction grooves 350 or suction grooves 360. On the other hand, in the restrictor sections 362' disposed in the both end portions in the axial direction, only one (the inner side) is connected to a suction groove 350, 360, while the other (the outer side) is closed off.

The restrictors 362 have a groove width (cross-sectional area) smaller than the groove width of the suction grooves 350, 360, and are disposed on the rear side of the closed section 208 shown in FIG. 11; the restrictors 362 have a structure in which the rear side (the side of the outer circumferential surface 204 of the image formation drum 44) is closed off by the closed sections 208. More specifically, the restrictor sections 362 (362') have a function of restricting the flow rate of air passing through the suction grooves 350, 360 and prevent the escape of pressure which suctions the recording medium 14.

Ribs 354, 356 having a projecting shape are provided in the suction grooves 350. The ribs 354, 356 have an island pattern and a height which is roughly equal to the depth of the suction grooves 350, 360. The ribs 354 are formed in a broken line configuration parallel to the axial direction. Furthermore, a plurality of rows (two rows in FIG. 12) of ribs 354 (rib rows) aligned in a broken line configuration following the axial direction are formed in parallel inside the suction grooves 350. The interval between the rib rows is approximately equal to the width of the suction grooves 360. Moreover, ribs 356 formed in a broken line shape along the circumferential direction are formed in the gaps between the ribs 354 which are aligned in parallel in the axial direction.

By providing island-shaped ribs 354, 356 which are respectively divided up in this way, it is possible to prevent the recording medium 14 held by suction on the medium supporting region 206 from becoming indented from a circular arc shape, and therefore a uniform throw distance can be maintained. Furthermore, since air is able to move through the gaps between the divided ribs 354, 356, it is possible to ensure the flow volume of air in the suction grooves 350.

Furthermore, a plurality of ribs 356 formed along the circumferential direction in the suction grooves 360 are provided in the axial direction. Gaps are provided between the walls of the suction grooves 360 and the ribs 356, in such a manner that air can move through these gaps.

Figure 13:
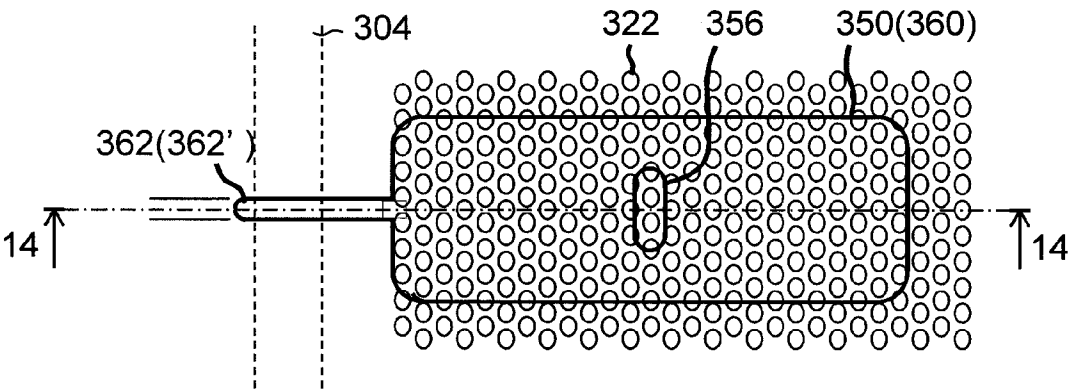
FIG. 13 is a plan view perspective diagram showing a structure of a vacuum flow channel in the image formation drum shown in FIG. 10.
Figure 14:
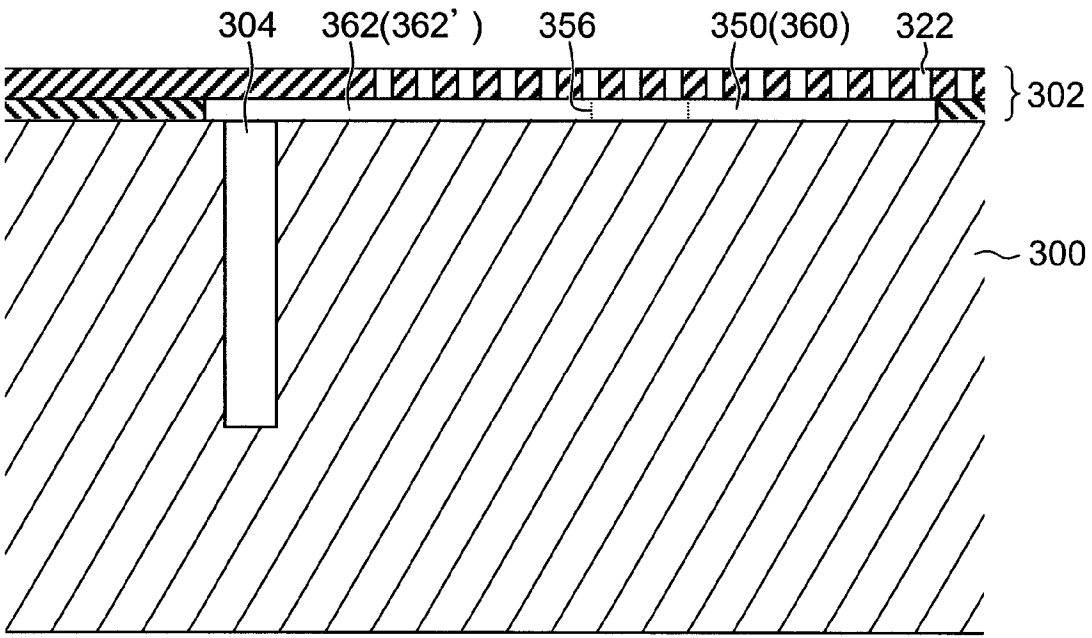
FIG. 14 is a cross-sectional diagram along line 14-14 in FIG. 13.

FIG. 13 is a diagram for illustrating the positional relationship between the suction holes 322 shown in FIG. 11 and the suction grooves 350, 360 shown in FIG. 12. Furthermore, FIG. 14 is a cross-sectional diagram along line 14-14 in FIG. 13. As shown in FIG. 13 and FIG. 14, a structure is adopted in which the suction holes 322 formed in the front surface of the suction sheet 302 are arranged so as to correspond to the arrangement of the suction grooves 350, 360 formed in the rear surface, and a portion of the suction holes 322 is connected to the suction grooves 350, 360. In other words, the arrangement pattern of the suction holes 322 corresponds to the pattern of the suction grooves 350 (360) on the rear surface. As shown in the drawings, there may also be a portion of the suction holes 322 which are not connected to the suction grooves 350 (360).

The width of the restrictor sections 362 is narrower than the width of the suction grooves 350 (360), and the restrictor sections 362 and the suction grooves 350 (360) have substantially the same depth. In other words, the flow channel cross-sectional area of the restrictor sections 362 (the cross-sectional area of the flow channel in a cross-section perpendicular to line 14-14 in FIG. 13) is smaller than the cross-sectional area of the flow channel of the suction grooves 360 (the cross-sectional area of a cross-section in the same direction), and the flow volume of air flowing in the suction grooves 350 (360) is restricted by the restrictor sections 362.

Furthermore, a drum suction groove 304 indicated by the broken line in FIG. 13 connects with the restrictor sections 362 (362') and connects with a vacuum flow channel provided inside the image formation drum 44 via a drum suction hole (see FIG. 10). Moreover, similarly to the restrictor sections 362, 362', the sides of the drum suction grooves adjacent to the outer circumferential surface 204 are closed off by the closed sections 208 (see FIG. 11).

It is also possible to think of the suction sheet 302 as being divided into a suction layer (suction sheet) in which suction holes 322 are provided and an intermediate layer (intermediate sheet) in which suction grooves 350, 360 and restrictor sections 362, 362' are provided. For example, it is possible to adopt a structure in which the suction layer and the intermediate layer are constituted by a single sheet-shaped member, and processing for forming suction holes 322 is carried out from one surface, and processing for forming suction grooves 350, 360 and restrictor sections 362, 362' is carried out from the other surface, and it is also possible to adopt a structure where a suction sheet formed with suction holes 322, and an intermediate sheet formed with suction grooves 350, 360 and restrictor sections 362, 362', are created, and the intermediate sheet is wrapped on a main body section 300 provided with a prescribed flow channel structure and a prescribed rotating mechanism, and the like, and the suction sheet is wrapped in a superimposed fashion on the intermediate sheet.

Desirably, the thickness of the front surface of the suction sheet 302 in which suction holes 322 are provided (thickness of suction sheet) is greater than the thickness of the rear surface of the suction sheet 302 where the suction grooves 350, 360, and the like, are provided (thickness of intermediate sheet). In the mode, as illustrated the figure, the thickness of the rear surface of the suction sheet 302 is approximately ½ with respect to the thickness of the front surface of the suction sheet 302. The smaller the thickness of the rear surface of the suction sheet 302, the more possible it becomes to obtain a high suction force by means of a small negative pressure, but if the layer is excessively thin, then blockages caused by paper dust, dirt and other foreign matters become liable to occur. Taking conditions such as these into consideration, the thickness of the rear surface of the suction sheet 302 is desirably, 0.05 mm to 0.5 mm, approximately.

The front surface of the suction sheet 302 needs to have a thickness that ensures rigidity sufficient to prevent sinking due to the suction pressure in the place where the ribs 354, 356 are not present therebelow, and corresponding flexibility is required in order to wrap and fix the front surface of the suction sheet 302 about the circumferential surface of the main body section 300.

With the vacuum flow channels described above, even if there are suction holes 322 and suction grooves 350, 360 which are open (to the air) when using a recording medium having a size smaller than a recording medium of maximum size, suction pressure does not escape via the open suction holes 322 and suction grooves 350, 360, due to the action of the restrictor section 362, 362', and it is possible to maintain a prescribed suction pressure force with respect to recording media 14 of various sizes.

The present embodiment describes, by way of an example, an image formation drum 44 having a laminated structure in which the suction sheet 302 is layered onto a main body section 300, but the image formation drum 44 to which the present invention can be applied is not limited to the laminated structure described above, and it is also possible to adopt a composition in which the main body section 300 and the suction sheet 302 are formed in an integrated fashion. Furthermore, the structure for vacuum suctioning the recording medium 14 is not limited to the structure described above, and it is also possible to use another structure.

MODIFICATION EXAMPLES

Next, modification examples of the image formation drum 44 relating to the present embodiment described above will be explained. In the following description, elements which are the same as or similar to the composition described previously are labeled with the same reference numerals and further explanation thereof is omitted here.

First Modification Example

Figure 15:
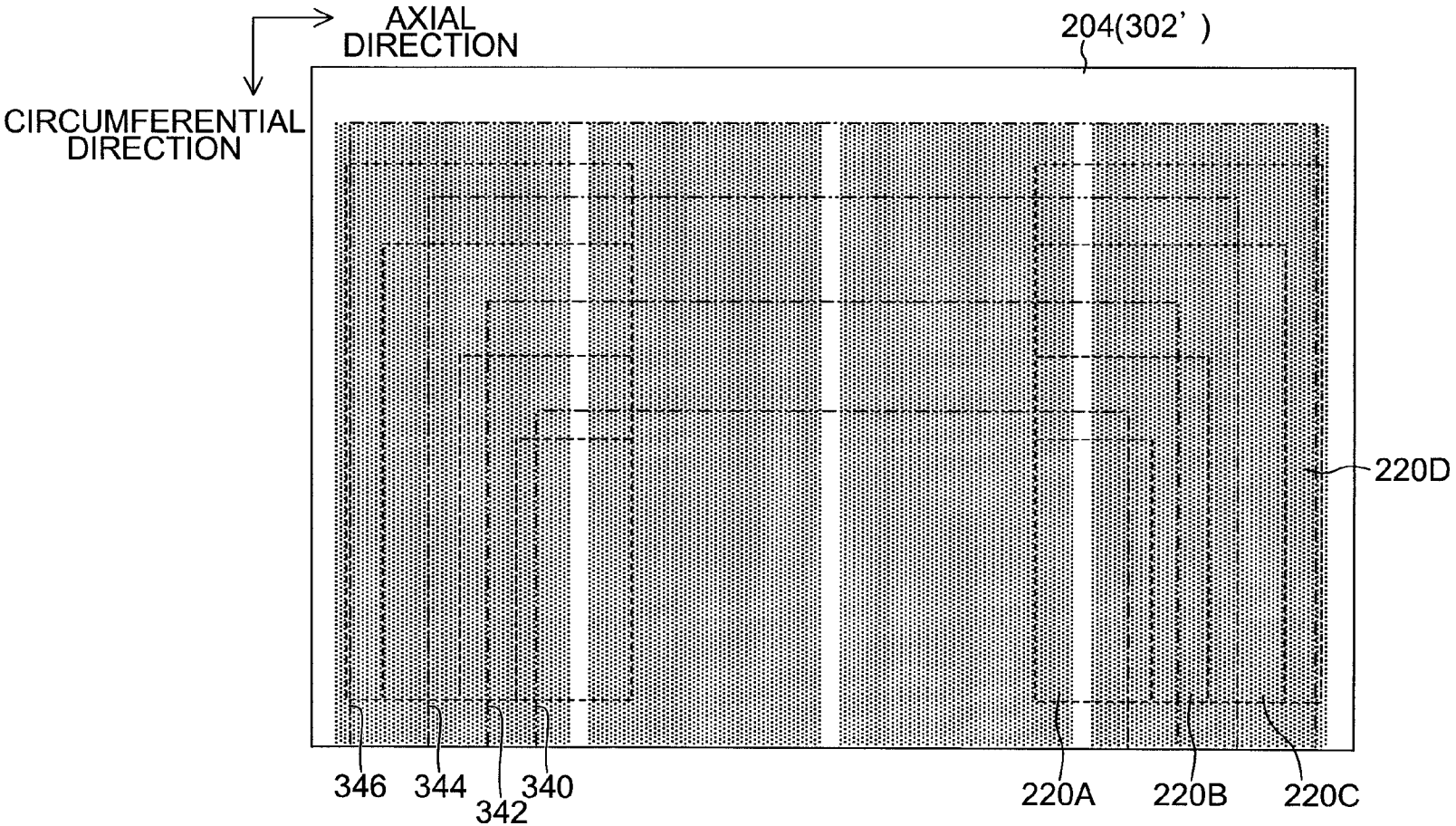
FIG. 15 is a projected diagram of a suction sheet showing an example of the structure of an image formation drum relating to a modification example of the present invention.

FIG. 15 is a plan diagram showing a projected view of the outer circumferential surface 204 (suction sheet 302') of an image formation drum 44 relating to a first modification example. The image formation drum 44 relating to the present modification example has a structure in which a suction sheet 302' is layered on the main body section 300 (see FIG. 10).

In the present modification example, suction sheets 302' are prepared for the respective sizes of recording medium 14, and the suction sheet 302' is changed when the size of the recording medium 14 is changed. The suction sheets 302 corresponding to the respective sizes are each provided with level difference coating sections 220A to 220D of shapes corresponding to the sizes of the recording medium 14.

For example, the suction sheet 302' used for a recording medium 14 of a size corresponding to the suction region labeled with reference numeral 340 is formed with level difference coating sections indicated by the dotted lines labeled with reference numeral 220A, and the suction sheets 302' used for recording media 14 corresponding to the suction regions labeled with reference numerals 342, 344, 346 are provided respectively with level difference coating sections labeled with reference numerals 220B, 220C and 220D.

By suitably changing the suction sheets 302' having this structure in accordance with the recording medium 14 being used, the occurrence of wrinkles when the recording medium 14 is caused to make tight contact with the image formation drum 44 can be prevented, while ensuring a suction pressure suited to the size of the recording medium 14.

Second Modification Example

Figure 16:
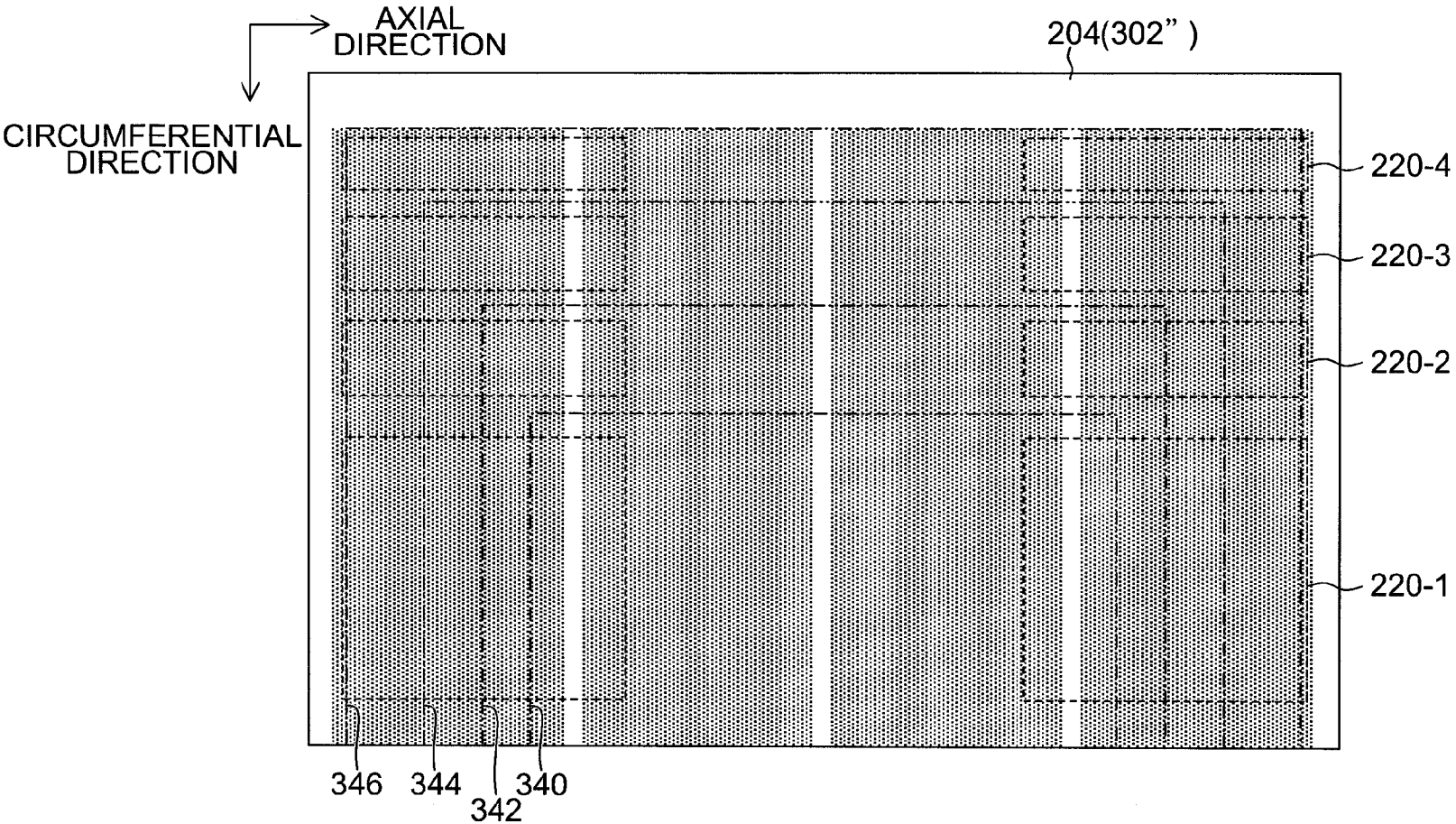
FIG. 16 is a projected diagram of a suction sheet showing an example of the structure of an image formation drum relating to a further modification example of the present invention.

FIG. 16 is a plan diagram showing a projected view of the outer circumferential surface 204 (suction sheet 302") of an image formation drum 44 relating to a second modification example. Similarly to the first modification example, the image formation drum 44 relating to this modification example is described in relation to a structure in which a suction sheet 302" is layered on the main body section 300.

The suction sheet 302" shown in FIG. 16 has a structure in which level difference coating sections 220 are divided into a plurality of regions. For example, the level difference coating sections 220 shown in FIG. 16 comprise a level difference coating section 220-1 for a recording medium 14 corresponding to the suction region labeled with reference numeral 340, a level difference coating section 220-2 for a recording medium 14 corresponding to the suction region labeled with reference numeral 342, a level difference coating section 220-3 for a recording medium 14 corresponding to the suction region labeled with reference numeral 344, and a level difference coating section 220-4 for a recording medium 14 corresponding to the suction region labeled with reference numeral 346.

In other words, in the suction sheet 302" shown in FIG. 16, the trailing end position of the suction region labeled with reference numeral 340 is situated between the level difference coating section 220-1 and the level difference coating section 220-2, the trailing end position of the suction region labeled with reference numeral 342 is situated between the level difference coating section 220-2 and the level difference coating section 220-3, the trailing end position of the suction region labeled with reference numeral 344 is situated between the level difference coating section 220-3 and the level difference coating section 220-4, and the trailing end position of the suction region labeled with reference numeral 346 is situated after the level difference coating section 220-4.

By using the suction sheet 302" having this structure, it is possible to respond to change in the size of the recording medium 14, without changing the suction sheet 302", and the occurrence of wrinkles when the recording medium 14 is caused to make tight contact with the image formation drum 44 can be prevented, while ensuring a suction pressure suited to the size of the recording medium 14.

In the embodiments and modification examples described above, a level difference coating section 220 having a quadrilateral planar shape is described, but it is also possible to use various planar shapes for the level difference coating sections 220. For instance, possible examples of the shape are an approximate fan shape in which the width in the circumferential direction of the image formation drum 44 becomes larger from the center toward the ends in the axial direction, or a triangular shape having a base edge following the axial direction and oblique edges following directions which intersect with the axial direction, and the like. Furthermore, each of the regions of the level difference coating sections 220 which are divided into a plurality of regions shown in FIG. 16 may be further divided and may adopt a combination of different planar shapes.

Example of Application to Other Apparatus Compositions

In the embodiment described above, an inkjet recording apparatus of a drum conveyance (pressure drum conveyance) type is given as an example of an image forming apparatus, but the scope of application of the present invention is not limited to this. For example, the present invention may also be applied to a conveyance method which conveys a recording medium in tight contact with a flat surface. Furthermore, the invention may be applied broadly to image forming apparatuses which use a medium having permeability to liquid. Moreover, the present invention displays particularly beneficial effects in an image forming apparatus in which image formation is performed on both surfaces of a recording medium, when forming an image onto one surface of a recording medium after image formation has been completed on the other surface of the recording medium.

APPENDIX

As has become evident from the detailed description of the embodiments given above, the present specification includes disclosure of various technical ideas including the aspects described below of the invention.

One aspect of the invention is directed to an image forming apparatus comprising: a conveyance drum which has a round cylindrical shape including an outer circumferential surface having a medium holding section, and rotates in a prescribed direction while holding a medium in tight contact on the medium holding section so as to convey the medium in a circumferential direction; a pressing device which presses the medium against the medium holding section so as to establish tight contact between the medium and the medium holding section, when causing the medium to make tight contact with the medium holding section; a holding force generating device which generates a holding force that holds the medium on the medium holding section; and a liquid ejection head which ejects a liquid onto the medium held on the medium holding section, wherein: the conveyance drum has a level difference section which is provided on at least one side, in an axial direction of the conveyance drum, with respect to a central portion in the axial direction of the conveyance drum, the level difference section having a larger diameter than the central portion so as to project beyond an outer circumferential surface of the central portion; and the level difference section has a length, in the circumferential direction, smaller than a length of the medium holding section in the circumferential direction.

According to this aspect of the present invention, floating up of the medium is prevented by pressing the medium against the outer circumferential surface of the conveyance drum with a pressing device and thereby causing the medium to make tight contact with the medium holding section, and since a level difference section is provided on at least one side of the central portion of the axial direction of the drum, the level difference section having a larger diameter than the central portion of the axial direction and projecting beyond the outer circumferential surface of the central portion of the axial direction, then the occurrence of wrinkles when causing the medium to make tight contact with the outer circumferential surface of the conveyance drum is suppressed, even when using a medium having a large amount of deformation. Moreover, since the level difference section has a length in the circumferential direction which is smaller than the length of the medium holding section in the circumferential direction, then the holding force generated in the medium holding section acts directly on the portion of the medium that is not supported on the level difference section, and therefore detachment of the medium due to insufficient holding force is prevented.

The present invention displays a particularly beneficial effect in respect of a medium having especially large deformation in the edge portions, such as a medium which has completed image formation on one surface during a double-side image formation process. Moreover, more beneficial effects can be obtained in respect of a medium having a large amount of deformation in the edge portions in the direction perpendicular to the direction of conveyance of the medium.

The "central portion in the axial direction" is a region including the central position in the axial direction, and a desirable mode is one where the central position of the central portion in the axial direction coincides with the central position of the conveyance drum in the axial direction. For example, there is a mode where the length of the central portion in the axial direction is not less than ⅓ and not more than ½ of the total length in the axial direction.

A desirable mode is one where level difference sections are provided on either side in the axial direction of the central portion in the axial direction. Furthermore, desirably, the planar shape of the level difference section is a substantially quadrilateral shape. A possible method of forming a level difference section is a mode where a coating material having a prescribed rigidity and bending strength is applied.

One possible example of the holding force generating device which holds a medium on the medium holding section is a mode where a plurality of suction holes are provided in the surface which makes contact with the medium, and a medium is held by suction through generating a negative pressure in the suction holes.

Desirably, the conveyance drum includes a fixing device which fixes a leading end of the medium in a conveyance direction.

According to this mode, even if using a medium of high rigidity, the leading end of the medium is held reliably and floating up of the leading end is prevented.

One possible example of the fixing device in this mode is a gripper which has a hook shape and grips the leading end of the medium.

Desirably, the conveyance drum has a leading end side non-level difference section between the fixing device and the level difference section in the circumferential direction, the leading end side non-level difference section having a same diameter as the central portion.

According to this mode, it is possible to hold the leading end portion of the medium more reliably, and floating up of the leading end portion of the medium is prevented.

Desirably, the conveyance drum has a trailing end side non-level difference section between the level difference section and a trailing end position in a conveyance direction of the recording medium, in the circumferential direction, the trailing end side non-level difference section having a same diameter as the central portion.

According to this mode, the trailing end portion of the medium is prevented from detaching from the medium holding section and floating up.

Desirably, both ends of the level difference section in the axial direction are situated to the outer side of positions of ends of a medium of maximum size in the axial direction of the conveyance drum.

According to this mode, it is possible to distribute distortion produced by deformation of the medium, to either end of the medium in the axial direction of the conveyance drum, and the occurrence of wrinkles is suppressed.

Desirably, the level difference section has a graduated section where a thickness changes in an outer edge of the level difference section.

According to this mode, floating up of the medium at the edge of the level difference section is prevented.

The graduated section in this mode may be formed with an inclined shape or with a stepped shape.

Desirably, the level difference section generates a holding force smaller than a holding force generated in the central portion.

According to this mode, by making the holding force of the level difference section smaller than the central portion of the axial direction, the central portion of the medium is held before the respective end portions, and therefore the occurrence of wrinkles in the deformed medium is prevented. On the other hand, by generating the holding force which is smaller than the central portion in the axial direction, in the level difference section, the overall holding force is ensured.

In this mode, desirably, in the non-level difference section apart from the central portion in the axial direction (the region other than the level difference section), a holding force at least equal to that of the central portion in the axial direction should be generated.

Desirably, the medium holding section has a structure in which a plurality of suction holes generating a suction pressure are provided; and the level difference section has a structure in which at least a portion of the plurality of suction holes is closed off.

Desirably, the medium holding section has a structure in which a plurality of suction holes generating a suction pressure are provided; and the number of suction holes per unit surface area in the level difference section is smaller than the number of suction holes per unit surface area in the medium holding section.

In these aspects, it is possible to adopt a composition in which the suction holes in positions where the level difference section is provided are all closed off.

One possible example of a composition for generating a suction pressure in the suction holes is a mode where a flow channel connecting to each of the suction holes is provided in the conveyance drum and a suction device, such as a pump, is connected to the flow channel. Furthermore, one example of the composition of the flow channel is a mode comprising a groove which connects to each of the suction holes and a restrictor section having a smaller cross-sectional area than the groove and restricting the flow rate passing in the flow channel forming section, and have a function of generating a pressure loss in the flow channel forming section which is open to the air and thus impeding the escape of the pressure suctioning the medium, as well as having a structure whereby the medium holding surface side is closed off by a closed region (a no-opening region) where no openings are provided.

Desirably, a plurality of the level difference sections are provided in accordance with media of a plurality of sizes.

According to this mode, it is possible to respond to cases where media of different sizes are used.

Desirably, the conveyance drum has a structure in which a sheet-shaped member in which the level difference section is provided is wrapped about a main body section; and the level difference section having a structure corresponding to a size of the medium to be used is provided in the sheet-shaped member.

According to this mode, it is possible to respond to a plurality of sizes, by changing the sheet-shaped member in accordance with the size of the medium.

Desirably, the pressing device includes a pressing roller having a length corresponding to a length of the conveyance drum in the axial direction; and a portion of the pressing roller corresponding to the level difference section of the conveyance drum has a diameter equal to or greater than a diameter of a portion of the pressing roller corresponding to the central portion of the conveyance drum.

According to this mode, it is possible to cause the medium to make tight contact with the outer circumferential surface of the conveyance drum without floating up partially, by forming the pressing roller with a shape corresponding to the shape of the outer circumferential surface of the conveyance drum.

Desirably, the image forming apparatus further comprises: an output device which outputs the medium from the conveyance drum after an image has been formed on one surface of the medium; and a medium supply device which supplies the medium to the conveyance drum in such a manner that the other surface of the medium output by the output device faces the liquid ejection head, wherein the liquid ejection head forms an image on the other surface of the medium of which the image has been formed on the one surface.

According to this mode, the occurrence of floating up and wrinkles in the medium can be prevented, even in a medium having a large amount of deformation, such as a medium of which image formation has been carried out on one surface when performing image formation on both surfaces.

In this mode, desirably, a drying process device which carries out a drying process after image formation on one surface and a fixing process device which carries out a fixing process are also provided, in such a manner that the medium supply device supplies a medium after the fixing process to the medium holding section of the conveyance drum.

Furthermore, the present invention also encompasses the method invention described below. More specifically, an image forming method relating to the present invention comprises: a pressing step of pressing a medium so as to make tight contact with a medium holding section provided on an outer circumferential surface of a conveyance drum having a round cylindrical shape, a level difference section being provided on at least one side of a central portion in an axial direction of the conveyance drum, the level difference section having a larger diameter than the central portion and projecting beyond an outer circumferential surface of the central portion, and the level difference section having a length in the circumferential direction which is smaller than the length of the medium holding section in the circumferential direction; a conveyance step of conveying the medium in the circumferential direction by holding the medium on the medium holding section and rotating in a prescribed direction; and an image forming step of forming an image by ejecting liquid onto the medium held on the medium holding section.

This image forming method desirably comprises: an output step of outputting a medium from the conveyance drum after an image has been formed on one surface of the medium; and a medium supply step of supplying the medium to the conveyance drum in such a manner that the other surface of the medium output in the output step faces the liquid ejection head; wherein the image forming step forms an image on the other surface of the medium, on one surface of which an image has been formed.

Moreover, a desirable mode is one comprising a drying process step of carrying out a drying process on a medium after image formation on one surface and a fixing step of carrying out a fixing process on the medium after the drying process.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a conveyance drum which has a round cylindrical shape including an outer circumferential surface having a medium holding section, and rotates in a prescribed direction while holding a medium in tight contact on the medium holding section so as to convey the medium in a circumferential direction;

a pressing device which presses the medium against the medium holding section so as to establish tight contact between the medium and the medium holding section, when causing the medium to make tight contact with the medium holding section;

a holding force generating device which generates a holding force that holds the medium on the medium holding section; and a liquid ejection head which ejects a liquid onto the medium held on the medium holding section, wherein:

the conveyance drum has a level difference section which is provided on at least one side, in an axial direction of the conveyance drum, with respect to a central portion in the axial direction of the conveyance drum, the level difference section having a larger diameter than the central portion so as to project beyond an outer circumferential surface of the central portion;

the level difference section has a length, in the circumferential direction, smaller than a length of the medium holding section in the circumferential direction;

the level difference section is provided in the medium holding section of the conveyance drum: the conveyance drum includes a fixing device which fixes a leading end of the: medium in a conveyance direction; and the fixing device is provided in a recess section in the outer circumference of the conveyance drum;

wherein the thickness of the level difference section is not less than 50 μm and not more than 500 μm;

and wherein the level difference section is provided with suction holes.

2. The image forming apparatus as defined in claim 1, wherein the conveyance drum has a leading end side non-level difference section between the fixing device and the level difference section in the circumferential direction, the leading end side non-level difference section having a same diameter as the central portion.

3. The image forming apparatus as defined in claim 1, wherein the conveyance drum has a trailing end side non-level difference section between the level difference section and a trailing end position in a conveyance direction of the recording medium, in the circumferential direction, the trailing end side non-level difference section having a same diameter as the central portion.

4. The image forming apparatus as defined in claim 1, wherein both ends of the level difference section in the axial direction are situated to the outer side of positions of ends of a medium of maximum size in the axial direction of the conveyance drum.

5. The image forming apparatus as defined in claim 1, wherein the level difference section has a graduated section where a thickness changes in an outer edge of the level difference section.

6. The image forming apparatus as defined in claim 1, wherein the level difference section generates a holding force smaller than a holding force generated in the central portion.

7. The image forming apparatus as defined in claim 1, wherein:

the medium holding section has a structure in which a plurality of suction holes generating a suction pressure are provided; and the level difference section has a structure in which at least a portion of the plurality of suction holes is closed off.

8. The image forming apparatus as defined in claim 1, wherein:

the medium holding section has a structure in which a plurality of suction holes generating a suction pressure are provided; and the number of suction holes per unit surface area in the level difference section is smaller than the number of suction holes per unit surface area in the medium holding section.

9. The image forming apparatus as defined in claim 1, wherein a plurality of the level difference sections are provided in accordance with media of a plurality of sizes.

10. The image forming apparatus as defined in claim 1, wherein:

the conveyance drum has a structure in which a sheet-shaped member in which the level difference section is provided is wrapped about a main body section; and the level difference section having a structure corresponding to a size of the medium to be used is provided in the sheet-shaped member.

11. The image forming apparatus as defined in claim 1, wherein:

the pressing device includes a pressing roller having a length corresponding to a length of the conveyance drum in the axial direction; and a portion of the pressing roller corresponding to the level difference section of the conveyance drum has a diameter less than a diameter of a portion of the pressing roller corresponding to the central portion of the conveyance drum.

12. The image forming apparatus as defined in claim 1, further comprising:

an output device which outputs the medium from the conveyance drum after an image has been formed on one surface of the medium; and a medium supply device which supplies the medium to the conveyance drum in such a manner that the other surface of the medium output by the output device faces the liquid ejection head, wherein the liquid ejection head forms an image on the other surface of the medium of which the image has been formed on the one surface.

13. The image forming apparatus as defined in claim 1, wherein the level difference sections are provided on either side of the central portion, and length of the central portion in the axial direction of the conveyance drum is not more than ⅓ of the total length of the medium holding section.

* * * * *